US008573185B2

(12) United States Patent
Miura et al.

(10) Patent No.: US 8,573,185 B2
(45) Date of Patent: Nov. 5, 2013

(54) DIAGNOSTIC DEVICE FOR INTERNAL-COMBUSTION ENGINE

(75) Inventors: Ryusei Miura, Hitachi (JP); Yoichi Iihoshi, Tsuchiura (JP); Akihito Numata, Hitachiota (JP); Eisaku Fukuchi, Mito (JP); Yoshikuni Kurashima, Mito (JP)

(73) Assignee: Hitachi, Ltd, Tokyo (JP)

( * ) Notice: Subject to any disclaimer, the term of this patent is extended or adjusted under 35 U.S.C. 154(b) by 0 days.

(21) Appl. No.: 13/513,211

(22) PCT Filed: Dec. 14, 2010

(86) PCT No.: PCT/JP2010/072448
§ 371 (c)(1),
(2), (4) Date: Jun. 1, 2012

(87) PCT Pub. No.: WO2011/074563
PCT Pub. Date: Jun. 23, 2011

(65) Prior Publication Data

US 2012/0245824 A1 Sep. 27, 2012

(30) Foreign Application Priority Data

Dec. 16, 2009 (JP) ..... 2009-285316

(51) Int. Cl.
*F02M 59/36* (2006.01)

(52) U.S. Cl.
USPC ..... 123/458; 123/497; 123/198 D; 701/107; 701/114

(58) Field of Classification Search
USPC ..... 123/458, 497, 198 D; 701/103–105, 701/107, 114; 73/114.38, 114.41, 114.43
See application file for complete search history.

(56) References Cited

U.S. PATENT DOCUMENTS 5,499,538 A * 3/1996 Glidewell et al. ..... 73/114.41
6,209,521 B1 * 4/2001 Rembold et al. ..... 123/456

(Continued)

FOREIGN PATENT DOCUMENTS

EP 1 726 809 A1 11/2006
JP 2000-73828 A 3/2000

(Continued)

OTHER PUBLICATIONS

PCT/ISA/237 Form (Five (5) pages).

(Continued)

*Primary Examiner* — Thomas Moulis
(74) *Attorney, Agent, or Firm* — Crowell & Moring LLP

(57) ABSTRACT

An anomaly in a high-pressure fuel system of an internal combustion engine is diagnosed early on and with high precision, and, further, the anomaly site is identified. With respect to a diagnostic device for a direct injection internal combustion engine, there is provided: an injection correction amount computation means (302) that computes an injection correction amount so as to bring a detected air-fuel ratio to a target air-fuel ratio; a fuel injection valve control means (202) that controls the fuel injection valves with the fuel injection amount corrected based on the injection correction amount; a discharge correction amount computation means (305) that computes a discharge correction amount so as to bring a detected fuel pressure to a target fuel pressure; a fuel pump control means (203) that controls the fuel pump with the discharge amount corrected based on the discharge correction amount; a fuel pressure value shifting means (204) that shifts the value of the detected fuel pressure if the injection correction amount deviates from a predetermined range and until the injection correction amount converges to a given amount within the predetermined range; and an anomaly determination means (306) that determines which of the fuel pump, the fuel injection valves, and the fuel pressure sensor has an anomaly based on the discharge correction amounts before the fuel pressure values shift starts and after the fuel pressure value shift ends, and on the injection correction amount before the fuel pressure value shift starts.

10 Claims, 21 Drawing Sheets

(56) References Cited

U.S. PATENT DOCUMENTS

| | | | | |
|---|---|---|---|---|
| 6,283,108 | B1 * | 9/2001 | Matsufuji et al. | 123/690 |
| 6,474,306 | B2 * | 11/2002 | Muller et al. | 123/479 |
| 6,526,948 | B1 * | 3/2003 | Stavnheim et al. | 123/497 |
| 6,647,769 | B1 * | 11/2003 | Fujino et al. | 73/114.41 |
| 6,871,633 | B1 * | 3/2005 | Date et al. | 123/447 |
| 7,107,968 | B2 * | 9/2006 | Nomura | 123/456 |
| 7,418,337 | B2 * | 8/2008 | Toyohara et al. | 701/104 |
| 7,472,690 | B2 * | 1/2009 | Takayanagi et al. | 123/446 |
| 7,950,371 | B2 * | 5/2011 | Cinpinski et al. | 123/446 |
| 7,980,120 | B2 * | 7/2011 | Cinpinski et al. | 73/114.43 |
| 7,987,704 | B2 * | 8/2011 | Lucido et al. | 73/114.43 |
| 8,091,531 | B2 * | 1/2012 | Lucido et al. | 123/446 |
| 8,091,532 | B2 * | 1/2012 | Wang et al. | 123/446 |
| 8,210,155 | B2 * | 7/2012 | Ohta et al. | 123/446 |
| 2005/0005912 | A1 * | 1/2005 | Joos et al. | 123/458 |
| 2007/0251502 | A1 * | 11/2007 | Takayanagi et al. | 123/458 |
| 2009/0205413 | A1 * | 8/2009 | Yamauchi et al. | 73/114.41 |
| 2011/0231083 | A1 * | 9/2011 | Saruwatari et al. | 701/107 |

FOREIGN PATENT DOCUMENTS

| | | | |
|---|---|---|---|
| JP | 2002-21630 | A | 1/2002 |
| JP | 2006-322402 | A | 11/2006 |
| JP | 2007-127076 | A | 5/2007 |
| JP | 2010-25102 | A | 2/2010 |

OTHER PUBLICATIONS

International Search Report including English language translation dated Jan. 25, 2011 (Four (4) pages).

* cited by examiner

FIG. 21

| | Before fuel pressure correction | | | After fuel pressure correction | | |
|---|---|---|---|---|---|---|
| | Injection correction rate | Discharge correction amount | Fuel pressure correction amount | Injection correction rate | Discharge correction amount | Fuel pressure correction amount |
| Fuel pressure sensor | Outside of range | Outside of range | Within range | Within range | Within range | Outside of range |
| Injector | Outside of range | Outside of range | Within range | Within range | Outside of range | Outside of range |
| Air flow sensor | Outside of range | Within range | Within range | Within range | Outside of range | Outside of range |
| Air-fuel ratio sensor | Outside of range | Within range | Within range | Within range | Outside of range | Outside of range |
| Disturbance | Outside of range | Outside·within range | Within range | Within range | Within range | Within range |

DIAGNOSTIC DEVICE FOR INTERNAL-COMBUSTION ENGINE

TECHNICAL FIELD

The present invention relates to a diagnostic device for an internal combustion engine comprising a high-pressure fuel system in which highly pressurized fuel is supplied to the combustion chamber, and, more particularly, to a diagnostic device for an internal combustion engine that is suitable for identifying an anomaly site in a high-pressure fuel system.

In order to prevent exhaust degradation in internal combustion engines, techniques for diagnosing component and system anomalies that lead to exhaust degradation are being developed. In particular, anomalies in high-pressure fuel systems potentially cause air-fuel ratio offsets due to fuel injection errors, or combustion degradation due to fuel pressure offsets. Air-fuel ratio offsets result in a drop in catalytic conversion efficiency. On the other hand, combustion degradation due to fuel pressure offsets result in exhaust degradation at start-up. For these reasons, by way of example, the following diagnostic techniques have been disclosed.

For example, in Patent Document 1, as one such diagnostic technique, there is proposed a fuel system anomaly detection device for an internal combustion engine that determines a high-pressure fuel pump anomaly and a fuel pressure sensor anomaly based on an air-fuel ratio feedback correction amount and fuel pressure feedback correction amount that are obtained by varying the target fuel pressure in steps while executing air-fuel ratio feedback control and fuel pressure feedback control. In addition, in Patent Document 2, there is proposed a control device for an internal combustion engine that detects an anomaly in the fuel system based on a control amount for fuel pressure while executing air-fuel ratio feedback and fuel pressure feedback, and that identifies an anomaly site in the fuel system based on the air-fuel ratio feedback control amount and changes therein.

PRIOR ART DOCUMENTS

Patent Documents

Patent Document 1: JP Patent Application Publication (Kokai) No. 2002-21630 A

Patent Document 2: JP Patent Application Publication (Kokai) No. 2000-73828 A

SUMMARY OF THE INVENTION

Problems to be Solved by the Invention

However, in the case of the fuel system anomaly detection device of Patent Document 1, in carrying out anomaly determination, the target fuel pressure is varied in steps mandatorily as a prerequisite thereof. Accordingly, although air-fuel ratio feedback control is performed, air-fuel ratio offsets are caused upon thus varying, potentially resulting in a drop in catalytic conversion efficiency.

In addition, in the case of the control device disclosed in Patent Document 2, an anomaly site in the fuel system is identified based on the air-fuel ratio feedback control amount and changes therein. Accordingly, while it is possible to identify that the anomaly is in the fuel pressure system, it is not possible, with this single parameter alone, to identify the anomaly in greater detail, e.g., an anomaly in the high-pressure fuel pump, an anomaly in the injectors, etc. Thus, it would also be difficult to set suitable diagnostic criteria.

As such, in order to solve such problems, an object of the present invention is to provide a diagnostic device for an internal combustion engine that is capable of reliably determining anomalies in finer parts while maintaining the air-fuel ratio within a favorable range.

Means for Solving the Problems

In order to achieve the object mentioned above, the inventors, through diligent consideration, have obtained new insight that, with respect to diagnosing a high-pressure fuel system, even anomalies in the fuel injection valves, for example, may be detected by starting a diagnosis when there is an increase in the air-fuel ratio feedback amount (fuel injection correction amount) of air-fuel ratio feedback control, and, in so doing, deeming that a fuel pressure sensor has outputted a detection value that causes the air-fuel ratio feedback amount to decrease (for example, to 0).

The present invention is based on the above-mentioned new insight obtained by the inventors. A diagnostic device for an internal combustion engine according to the present invention is a diagnostic device for a direct injection internal combustion engine that comprises a fuel injection valve that injects fuel into a combustion chamber of the internal combustion engine, a fuel rail that stores fuel to be injected through the fuel injection valve, a fuel pump that discharges fuel into the fuel rail, a fuel pressure sensor that detects a fuel pressure within the fuel rail, and an air-fuel ratio sensor that detects an air-fuel ratio within exhaust gas discharged from the internal combustion engine, the diagnostic device comprising: injection amount computation means that computes an injection amount of the fuel injection valve based on an operation state of the internal combustion engine; injection correction amount computation means that computes an injection correction amount for the injection amount so as to bring the detected air-fuel ratio to a target air-fuel ratio; fuel injection valve control means that corrects the injection amount based on the injection correction amount, and controls the fuel injection valve so as to inject fuel in the corrected injection amount; discharge amount computation means that computes a discharge amount of the fuel pump based on the corrected fuel injection amount; discharge correction amount computation means that computes a discharge correction amount for the discharge amount so as to bring the detected fuel pressure to a target fuel pressure; fuel pump control means that corrects the discharge amount based on the discharge correction amount, and controls the fuel pump so as to discharge fuel in the corrected discharge amount; fuel pressure value shifting means that performs, when the injection correction amount deviates from a predetermined range, a shift in the value of the detected fuel pressure until the injection correction amount converges to a predetermined amount within the predetermined range; and anomaly determination means that determines which of the fuel pump, the fuel injection valve, and the fuel pressure sensor has an anomaly based on the discharge correction amount before the fuel pressure value shift starts and after the fuel pressure value shift ends and on the injection correction amount before the fuel pressure value shift starts. It is noted that the terms injection correction amount and injection correction rate only differ in terms of whether they are a correction amount to be added to the injection amount or by which the injection amount is to be multiplied. Since similar operations/effects are still obtained when injection correction amount is changed to injection correction rate, it would still be within the scope of the present invention even if the injection correction amount were an injection correction rate.

Effects of the Invention

With the present invention, it is possible to identify even anomaly components in the finer parts of a high-pressure fuel system, thereby making maintenance (component replacement) in the event of an anomaly easier. Further, more suitable diagnostic criteria may be set taking into consideration how the exhaust gas is affected depending on the anomaly component. Consequently, it is possible to detect anomalies early on, and to carry out a diagnosis that is robust against disturbances and model errors.

BRIEF DESCRIPTION OF THE DRAWINGS

FIG. 21 is a tabular diagram putting together anomaly determination results with respect to the flowchart shown in FIG. 15.

MODES FOR CARRYING OUT THE INVENTION

Several embodiments of the present invention are described below with reference to the drawings.

First Embodiment

Figure 1:
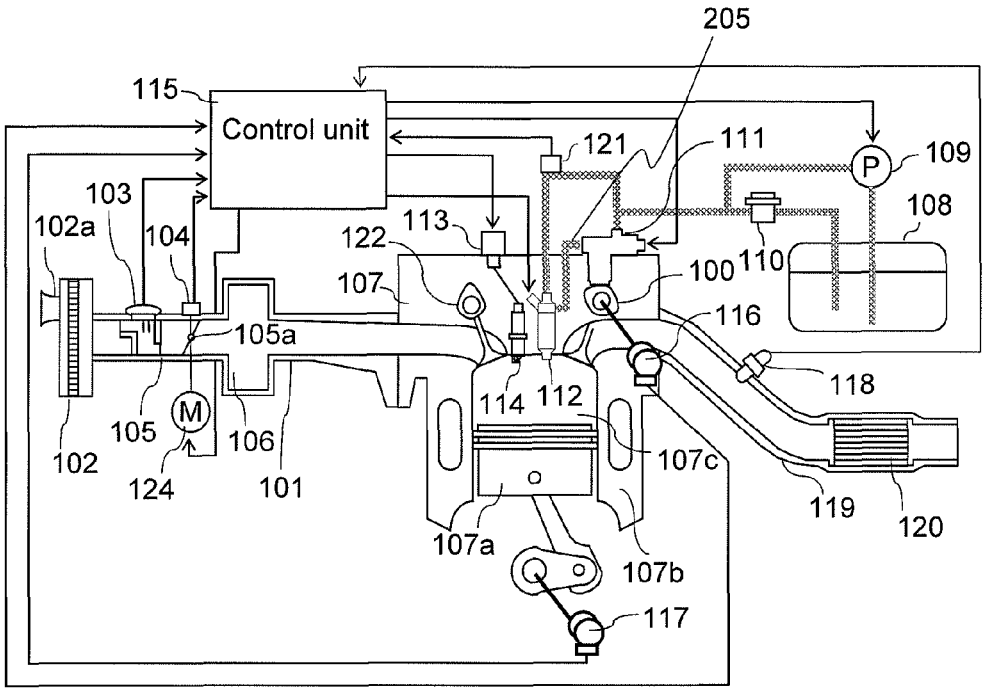
FIG. 1 is an overall configuration diagram of a direct injection internal combustion engine according to the present embodiments.

FIG. 1 is an example of an overall configuration diagram of a direct injection internal combustion engine according to the present embodiment. First, the intake air to be introduced into cylinders 107*b* is taken in from an inlet part 102*a* of an air cleaner 102, passes through an intake flow rate detection (sensing) means (an air flow sensor 103), which is one operation state measuring means of the internal combustion engine, passes through a throttle body 105 housing an electronically-controlled throttle valve 105*a* that controls the intake flow rate, and flows into a collector 106 disposed downstream thereof.

Here, a signal representing intake flow rate is outputted from the air flow sensor 103 to a control unit 115, which is a control device of the internal combustion engine. In addition, a throttle sensor 104, which is one operation state measuring means of the internal combustion engine and which detects the opening in the electronically-controlled throttle valve 105*a*, is attached to the throttle body 105, and a throttle valve opening signal, which is a signal thereof, is also outputted to the control unit 115. In addition, the control unit 115 outputs a control signal to a motor 124, thereby adjusting the opening in the electronically-controlled throttle valve 105*a*.

Further, the air taken into the collector 106 is distributed among intake pipes 101 respectively connected to the cylinders 107*b* of an internal combustion engine 107 comprising a plurality of cylinders, and is thereafter guided to combustion chambers 107*c* defined by pistons 107*a* and the cylinders 107*b*.

On the other hand, the fuel, such as gasoline, etc., undergoes primary pressurization at a fuel tank 108 by a low-pressure fuel pump 109, is adjusted to a certain pressure by a fuel pressure regulator 110, undergoes secondary pressurization by a high-pressure fuel pump (a fuel pump) 111 to a higher pressure, and is pumped (discharged) to a common rail (fuel rail) 205.

The discharged fuel is stored in the common rail 205 as fuel to be injected by fuel injection valves 112. In addition, the pressure of the highly pressurized fuel within the common rail 205 is detected by a fuel pressure sensor 121, and the fuel pressure thus detected (detected fuel pressure) is sent to the control unit 115 as a fuel pressure signal (sensor output voltage).

The high-pressure fuel thus stored in the common rail 205 is injected into the combustion chambers 107*c* through the fuel injection valves 112 provided on the respective cylinders 107*b*. The fuel injected into the combustion chambers 107*c* is ignited by ignition plugs 114 through an ignition signal whose voltage has been raised with an ignition coil 113.

In addition, the intake valve and the exhaust valve are opened/closed as a result of an intake-side cam 122 and an exhaust-side cam 100 rotating, respectively. A cam angle sensor 116 attached to the cam shaft of the exhaust valve detects the phase of the cam shaft, and outputs the detected phase to the control unit 115 as a cam angle signal. In addition, a crank angle sensor 117 is provided on the crankshaft to detect the rotation and phase of the crankshaft of the internal combustion engine, and the crank angle, which is its output, is outputted to the control unit 115 as a signal. Further, an air-fuel ration sensor 118 provided upstream of a catalyst 120 in an exhaust pipe 119 detects the oxygen in the exhaust gas, and outputs its detection signal to the control unit 115 as a detected air-fuel ratio.

Figure 2:
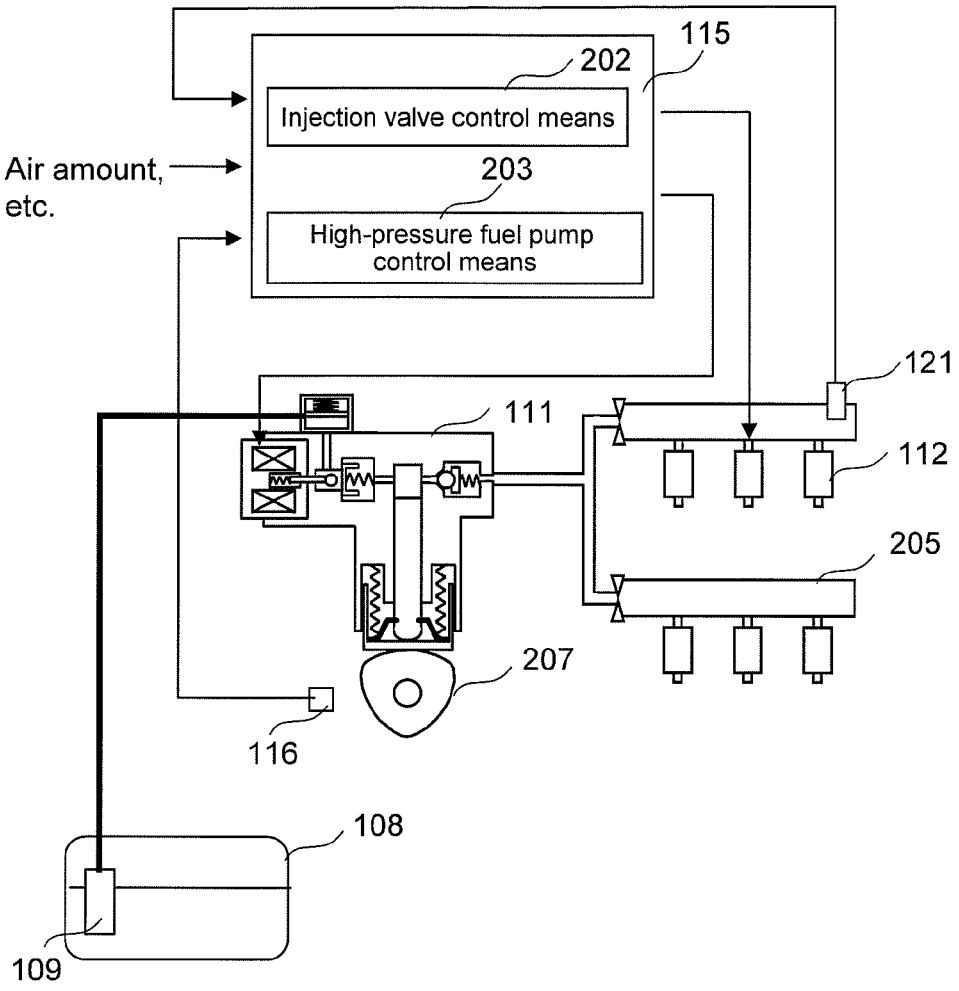
FIG. 2 is a schematic diagram of a key part of a high-pressure fuel control system of the internal combustion engine shown in FIG. 1.

FIG. 2 is a schematic diagram of a key part of a high-pressure fuel control system of the internal combustion engine 107 shown in FIG. 1. The control unit 115 controlling the high-pressure fuel system comprises an injection valve control means 202 and a high-pressure fuel pump control means 203. The injection valve control means 202 controls the fuel injection valves 112 based on the intake flow rate (intake air amount) detected at the air flow sensor 103, the air-fuel ratio detected at the air-fuel ratio sensor 118, the revolution rate of the internal combustion engine 107 detected at the crank angle sensor, etc. At the high-pressure fuel pump control means 203, the high-pressure fuel pump 111 is controlled based on the outputs obtained from the fuel pressure sensor 121, which is installed on the fuel rail 205 accumulated the fuel that is sucked from the fuel tank 108 by the low-pressure fuel pump 109, as well as from the cam angle sensor 116 for a cam 207 that drives the high-pressure fuel pump 111. Details of a fuel injection valve control device and of a high-pressure fuel pump control means according to the present embodiment are described in connection with FIG. 3 below.

Figure 3:
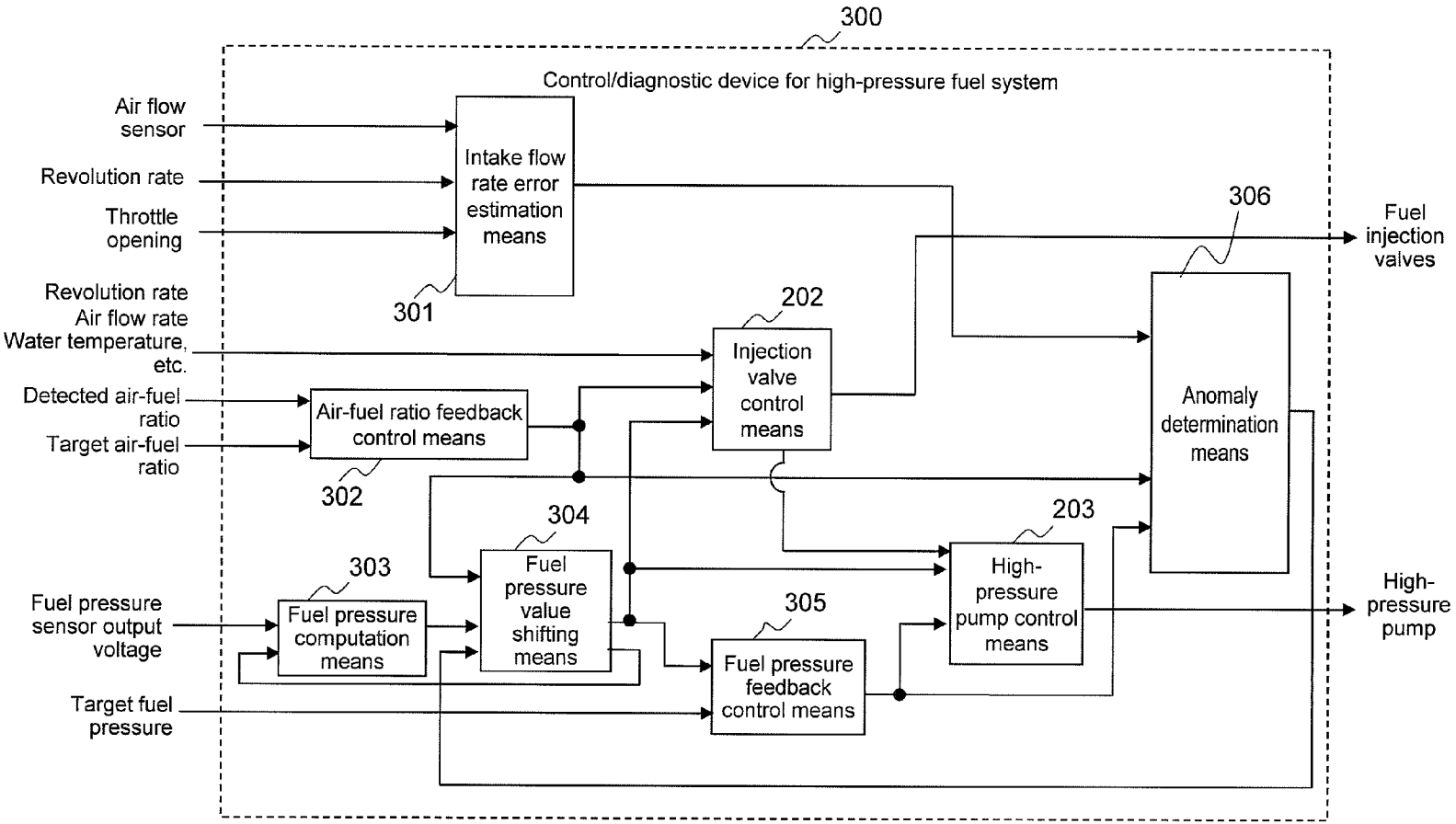
FIG. 3 shows a control/diagnostic device for a high-pressure fuel system (a diagnostic device for an internal combustion engine) according to the first embodiment.

A control/diagnostic device (diagnostic device) for a high-pressure fuel system of an internal combustion engine according to the first embodiment of the present invention is described below with reference to FIG. 3 through FIG. 10. FIG. 3 is an example of a block diagram of a high-pressure fuel system control/diagnostic device (a diagnostic device for an internal combustion engine) 300 according to the first embodiment.

The control/diagnostic device (diagnostic device) 300 comprises: the injection valve control means 202; the high-pressure fuel pump control means 203; an intake flow rate error estimation means 301; an air-fuel ratio feedback control means (injection correction amount computation means) 302; a fuel pressure computation means 303; a fuel pressure value shifting means 304; a fuel pressure feedback means (discharge correction amount computation means) 305; and an anomaly determination means 306.

Based on the detected air-fuel ratio and a target air-fuel ratio that is computed from such operation conditions as engine load, intake air amount, etc., the air-fuel ratio feedback control means 302 computes an injection correction amount (or injection correction rate) for the injection amount corresponding to an air-fuel ratio feedback amount so as to match the detected air-fuel ratio with the target air-fuel ratio.

Based on the output voltage of the fuel pressure sensor, etc., the fuel pressure computation means 303 computes the fuel pressure (detected fuel pressure). Specifically, it converts the output voltage of the fuel pressure sensor 121 into fuel pressure based on Equation (1).

$$\text{Fuel pressure} = \text{fuel pressure sensor output voltage} \times \text{gain value} + \text{offset value} \quad (1)$$

Here, it is assumed that the relationship between fuel pressure sensor output voltage and fuel pressure is a linearly proportional relationship. However, the relationship between fuel pressure sensor output voltage and fuel pressure may also be non-linear. In this case, a fuel pressure profile with respect to output voltage would be stored, and the detected fuel pressure may be computed using this fuel pressure profile.

When an anomaly determination is made at the later-discussed anomaly determination means 306, the fuel pressure value shifting means 304 shifts the value of the detected fuel pressure based on the injection correction amount computed at the air-fuel ratio feedback control means 302. Here, as one such example, the detected fuel pressure computed at the fuel pressure computation means 303 is shifted so as to make the injection correction amount (feedback correction amount) be 0 (zero).

Then, based on the operation state of the internal combustion engine, e.g., the revolution rate of the internal combustion engine, the intake flow rate (intake air amount), the water temperature, etc., the injection valve control means 202 first computes a basic fuel injection amount (injection amount) (injection amount computation means). Next, this basic fuel injection amount (injection amount) is corrected with the injection correction amount computed at the air-fuel ratio feedback control means 302. In order to inject fuel in the corrected injection amount, based on this injection amount and the detected fuel pressure (ordinarily the detected fuel pressure computed at the fuel pressure computation means 303, but in the event of an anomaly, the detected fuel pressure as shifted at the fuel pressure value shifting means 304), the injection pulse width and injection timing of the fuel injection valves are computed, and a control signal based on these computed values is outputted to the fuel injection valves 112, thereby controlling the fuel injection valves 112.

The fuel pressure feedback means 305 (discharge correction amount computation means) computes a discharge correction amount so as to match the detected fuel pressure (ordinarily the detected fuel pressure computed at the fuel pressure computation means 303, but in the event of an anomaly, the detected fuel pressure as shifted at the fuel pressure value shifting means 304) with the target fuel pressure. The discharge correction amount mentioned above is a correction amount for correcting the basic discharge amount computed at the later-discussed high-pressure fuel pump control means 203. Specifically, this discharge correction amount corresponds to the difference between the fuel amount injected by the fuel injection valves 112 and the fuel amount discharged with the high-pressure fuel pump, and corresponds to the balance of in-coming and out-going fuel within the gallery of the common rail.

From the corrected injection amount (=basic fuel injection amount+injection correction amount) computed at the above-discussed injection valve control means 202, the high-pressure fuel pump control means 203 computes the basic discharge amount. Next, the computed basic discharge amount is corrected with the discharge correction amount computed by the fuel pressure feedback control means 305. Further, in order to discharge in the corrected discharge amount, based on this discharge amount and the detected fuel pressure (ordinarily the detected fuel pressure computed at the fuel pressure computation means 303, but in the event of an anomaly, the detected fuel pressure as shifted at the fuel pressure value shifting means 304), the operation timing of the electromagnetic valve of the high-pressure fuel pump 111 is computed to achieve the desired discharge amount. The high-pressure fuel pump control means 203 then outputs to the high-pressure fuel pump 111 a control signal corresponding to this operation timing, and thus controls the high-pressure fuel pump 111.

The intake flow rate error estimation means 301 estimates the intake flow rate (intake air amount) (computes an estimated intake flow rate) based on revolution rate, throttle opening, vehicle speed, etc., and computes the intake flow rate error relative to the intake flow rate detected (sensed) at the air flow sensor 103.

Based on the intake flow rate error computed by the intake flow rate error estimation means 301, the injection correction amount computed by the air-fuel ratio feedback control means 302, and the discharge correction amount computed by the fuel pressure feedback control means 305, the anomaly determination means 306 performs an anomaly determination for at least the fuel pressure sensor 121 or the high-pressure fuel pump 111, and preferably also performs an anomaly determination for the fuel injection valves 112, the air flow sensor 103, and the air-fuel ratio sensor 118 through a shift in fuel pressure value, which will be discussed later.

Figure 4:
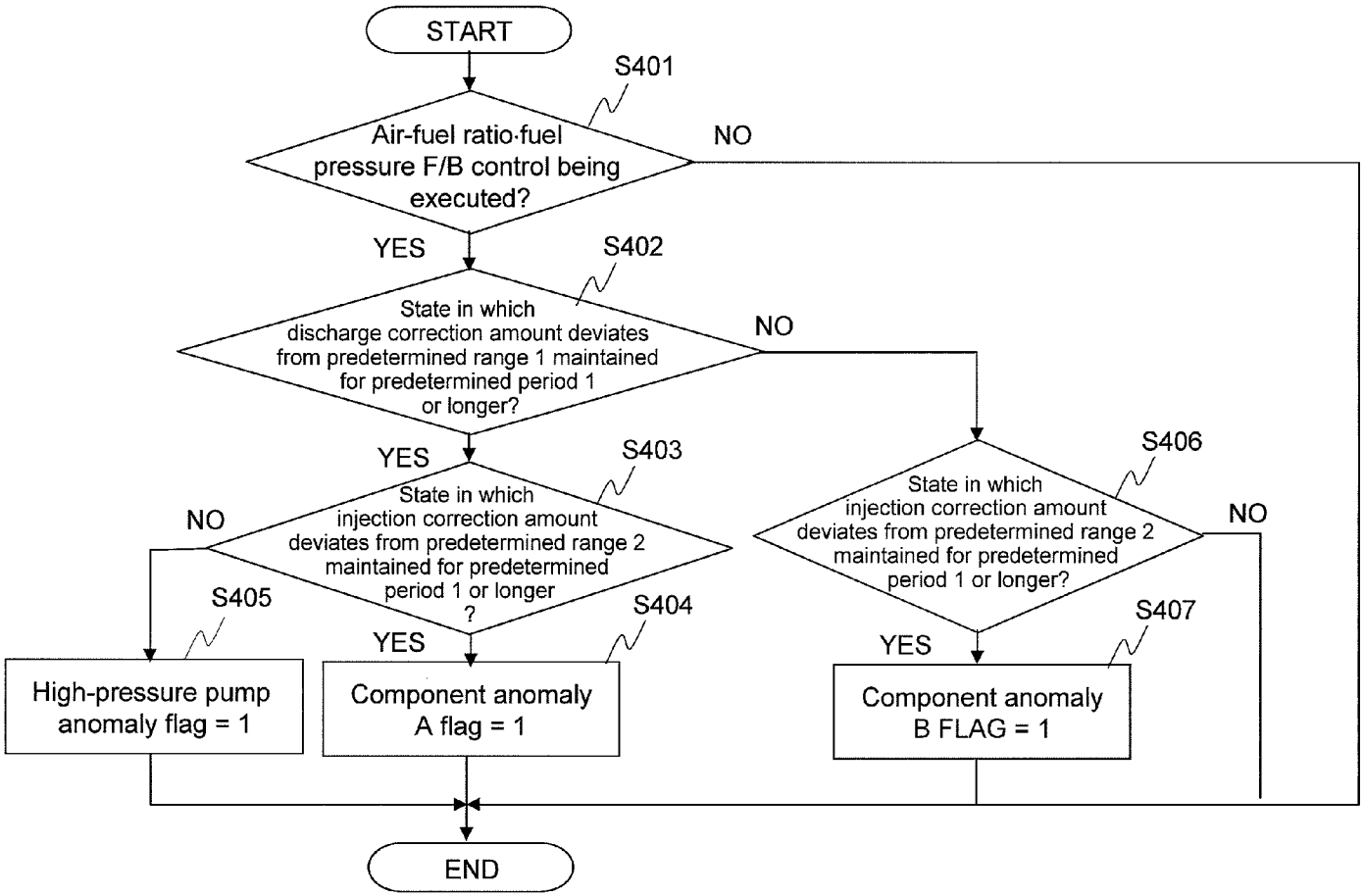
FIG. 4 is a flowchart for a diagnostic method performed by a diagnostic device for a high-pressure fuel system according to the present embodiments.

FIG. 4 is an example of a flowchart for a diagnostic method performed by a diagnostic device for a high-pressure fuel system according to the present embodiment.

First, in step S401, it is determined whether or not air-fuel ratio feedback control and fuel pressure feedback control are being executed. Since the subsequent processes are not executed until step S401 returns a YES, step S401 is an authorization condition for the present diagnostic method.

If step S401 returns a YES, the process proceeds to step S402. In this step, it is determined whether or not a state in which the discharge correction amount deviates from predetermined range 1 has been sustained for predetermined period 1 or longer. This predetermined range 1 for the discharge correction amount is a pre-defined range of from the maximum discharge correction amount to the minimum discharge correction amount obtained by combining discharge correction amounts calculated with respect to a case where the manufacturing variability in the various fuel system components is greatest. Predetermined period 1 refers to a period of time in which the influence of disturbances such as evaporation, etc., even if they were to take place, would be sufficiently small. Here, this predetermined range 1 is a reference range for the discharge correction amount, which serves as a reference for anomaly determination in the context of the present invention.

In general, the discharge correction amount increases due to fuel imbalances within the gallery, and this parameter is a parameter that is related to fuel pressure sensor anomalies, injection vale anomalies, and high-pressure fuel pump anomalies. Specifically, if there is a prolonged and significant discrepancy between the target fuel pressure and the detected fuel pressure (if the discharge correction amount deviates from predetermined range 1) to such an extent as to be improbable under ordinary fuel pressure F/B control, it may be determined that one of the following holds true: that the detected fuel pressure of the fuel pressure sensor within the common rail is not an appropriate value; that the fuel injection valves are not successfully injecting an appropriate amount of fuel from the common rail; or that the high-pressure fuel pump is not successfully discharging an appropriate amount of fuel to the common rail. In other words, it may be determined that there is an anomaly in the fuel system, namely the fuel pressure sensor, the fuel injection valves, or the high-pressure fuel pump. Thus, in step S402, it is determined whether it is an anomaly in the fuel system or some other anomaly. YES signifies an anomaly in the fuel system, and NO some other anomaly.

The process proceeds to step S403 if step S402 returns a YES, or to step S406 if step S402 returns a NO. If step S402 returns a YES and the process proceeds to step S403, it is determined whether or not a state in which the injection correction amount deviates from predetermined range 2 has been sustained for predetermined period 1 indicated above or longer. This predetermined range 2 is a pre-defined range of from the maximum injection correction amount to the minimum injection correction amount obtained by combining injection correction amounts with the greatest manufacturing variability in the various fuel system components.

If step S403 returns a YES, the process proceeds to step S404, and a component anomaly A flag is set to 1. If step S403 returns a NO, the process proceeds to step S405, and a high-pressure fuel pump anomaly flag is set to 1. It is noted that component anomaly A denotes a failure (anomaly) in the fuel injection valves or the fuel pressure sensor.

Here, having identified in step S402 that there is an anomaly in the fuel system, it is possible to further identify in step S403 its site within the system. Specifically, if the injection correction amount has been sustaining a correction amount that is improbable under ordinary air-fuel ratio F/B control (if there has been a prolonged and significant discrepancy between the target air-fuel ratio and the detected air-fuel ratio), it may be determined that an appropriate amount of fuel is not being injected successfully from the fuel injection valves injecting into the cylinders, or that the fuel pressure used for fuel injection valve control is not an appropriate value, and it may thus be determined that the failure is in the fuel injection valves or the fuel pressure sensor. Otherwise, it may be determined that there is no anomaly in the fuel injection system, and therefore that the failure is in the high-pressure fuel pump (high-pressure fuel pump anomaly), which is in the fuel discharge system for the common rail.

Conversely, if step S402 returns a NO and the process proceeds to step S406, it is determined whether or not a state in which the injection correction amount (air-fuel ratio feedback amount) deviates from predetermined range 2 has been sustained for predetermined period 1 indicated above or longer. If step S406 returns a YES, the process proceeds to step S407, and a component anomaly B flag is set to 1. If step S406 returns a NO, the process of the present flowchart is terminated. Component anomaly B denotes a failure (anomaly) in the air flow sensor or the air-fuel ratio sensor.

Here, having identified in step S402 that there is an anomaly somewhere other than the fuel system, it is possible to further identify in step S406 its site within the system. Specifically, if the injection correction amount has been sustaining an injection correction amount that is improbable under ordinary air-fuel ratio F/B control (if there has been a prolonged and significant discrepancy between the target air-fuel ratio and the detected air-fuel ratio), it may be determined that the intake air amount for computing the target injection amount is not being detected properly, or that the air-fuel ratio itself is not being detected properly, and it may thus be determined that the failure is in the air flow sensor or the air-fuel ratio sensor.

Figure 5:
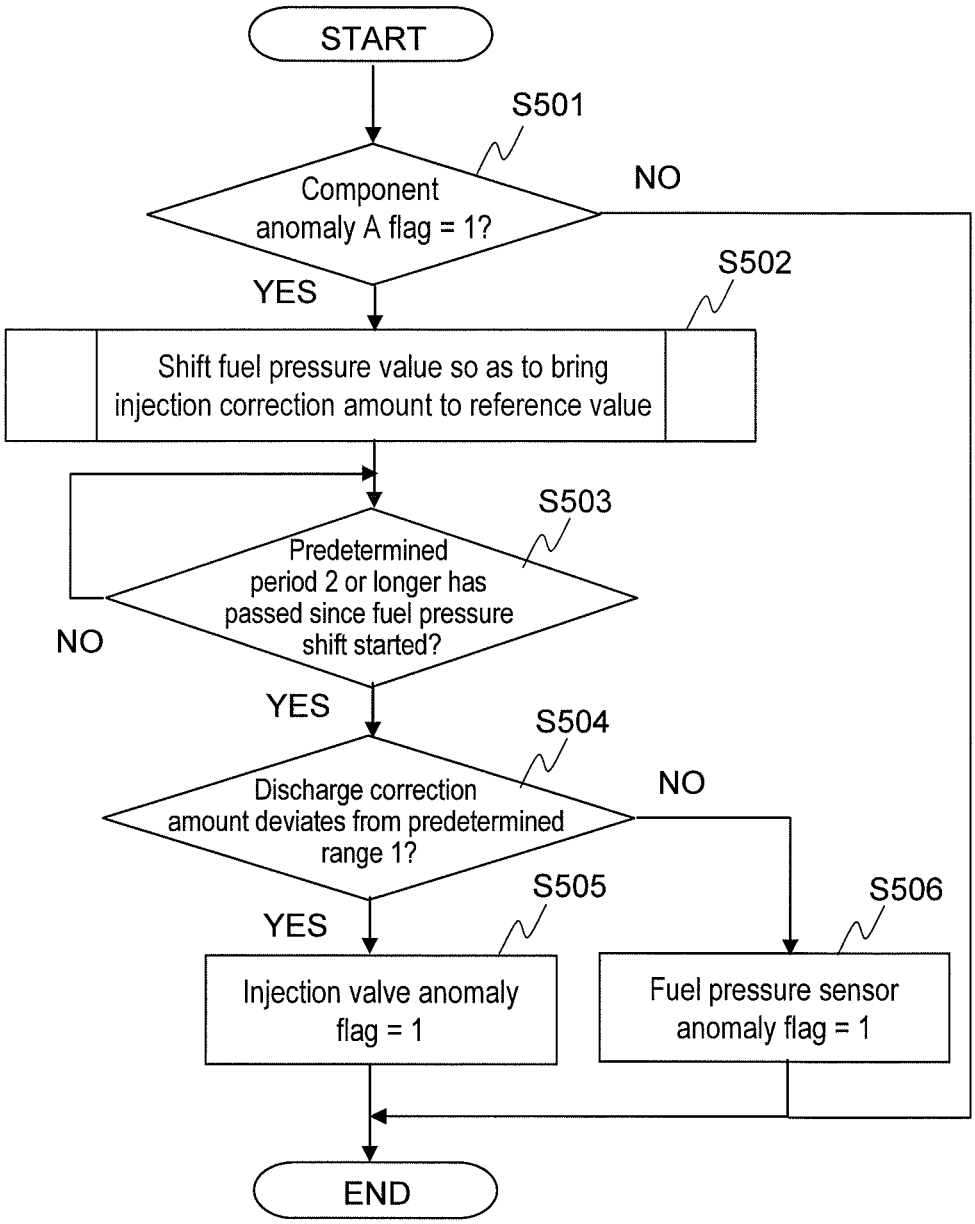
FIG. 5 is a flowchart for further separating between anomalies in the fuel injection valves and the fuel pressure sensor after a flag for component anomaly A (an anomaly in the high-pressure fuel system) has been set in step 404 shown in FIG. 4.

FIG. 5 is an example of a flowchart for further separating between anomalies in the fuel injection valves and the fuel pressure sensor after the flag for component anomaly A (an anomaly in the high-pressure fuel system) has been set in step S404 shown in FIG. 4.

First, in step S501, it is determined whether or not the component anomaly A flag is set to 1. Subsequent processes are not executed until step S501 returns a YES.

If step S501 returns a YES, the injection correction amount is outside of predetermined range 2. In this case, the process proceeds to step S502, and the fuel pressure value shifting means shifts the fuel pressure value until the injection correction amount converges to a pre-defined reference value. Specifically, the fuel pressure value shifting means deems that the detected fuel pressure has been detected, and forcibly shifts the fuel pressure value of this detected fuel pressure within the control system so as to reduce the difference between the target injection amount and the actual injection amount. This reference value is a given value pre-defined within an injection correction amount range (predetermined range) indicating a normal state for the fuel injections valves, and is preferably 0.

With respect to this fuel pressure value shift by the fuel pressure value shifting means, it is preferable that a fuel pressure value shift amount be calculated based on the difference between the injection correction amount and the reference value, and that the detected fuel pressure value be shifted at a rate that does not cause the fuel pressure to vary significantly through fuel pressure control. By way of example, the amount of change in the detected fuel pressure value, which varies in accordance with the correction to the fuel injection amount prior to starting the shift, may be stored, and the fuel pressure value shift may be performed based on this change amount. The amount of change (rate of change) in the fuel pressure value shift amount may thus be made comparable to the amount of change with respect to the operation state up to that point. Consequently, with respect to the injection valve control means 202, the high-pressure fuel pump control means 203, and the fuel pressure feedback control means 305 that use the corrected fuel pressure, abrupt changes in parameters that affect this fuel pressure parameter may be prevented, and exhaust characteristics degradation due to abrupt changes in parameters may be prevented.

In S503, it is determined whether or not predetermined period 2 or longer has passed since the fuel pressure value shift began. Here, predetermined period 2 is a period of time that is positively longer than it takes for the shift amount for the fuel pressure value to stabilize from when the fuel pressure value shift is started. By setting such a period of time, the fuel pressure is first stabilized through the process of step 502.

The process proceeds to step S504 if the determination result is YES in step S503. If the determination result is NO in step S503, subsequent processes are not executed until predetermined period 2 passes. In step S504, it is determined whether or not the discharge correction amount deviates from predetermined range 1. If step S504 returns a YES, the process proceeds to step S505, and a fuel injection valve anomaly flag is set to 1. If step S504 returns a NO, the process proceeds to step S506, and a fuel pressure sensor anomaly flag is set to 1. Thus, based on the discharge correction amount after the fuel pressure value has been shifted, it is possible to separate between anomalies in the fuel pressure sensor and the injection valves (injectors).

Thus, in step S504, if the discharge correction amount falls within the range of predetermined range 1, since it may be inferred that the fuel imbalance within the gallery has decreased as a result of performing a fuel pressure shift, it is possible to determine that the anomaly is in the fuel pressure sensor. On the other hand, if the discharge correction amount deviates from predetermined range 1, since it may be inferred that the fuel balance within the gallery does not decrease even when a fuel pressure shift is performed, it is possible to determine that the anomaly is in the fuel injection valves.

Thus, in the present embodiment, the fuel pressure is shifted based on the injection correction amount, and anomalies in the high-pressure fuel system may be determined based on the discharge correction amounts and injection correction amounts (air-fuel ratio feedback amounts) before and after the shift. Further, it is possible to separate between anomalies in the high-pressure fuel system, which comprises the high-pressure fuel pump, the injectors, and the fuel pressure sensor, and anomalies in non-high-pressure fuel system components, namely the air flow sensor and the air-fuel ratio sensor.

Figure 6:
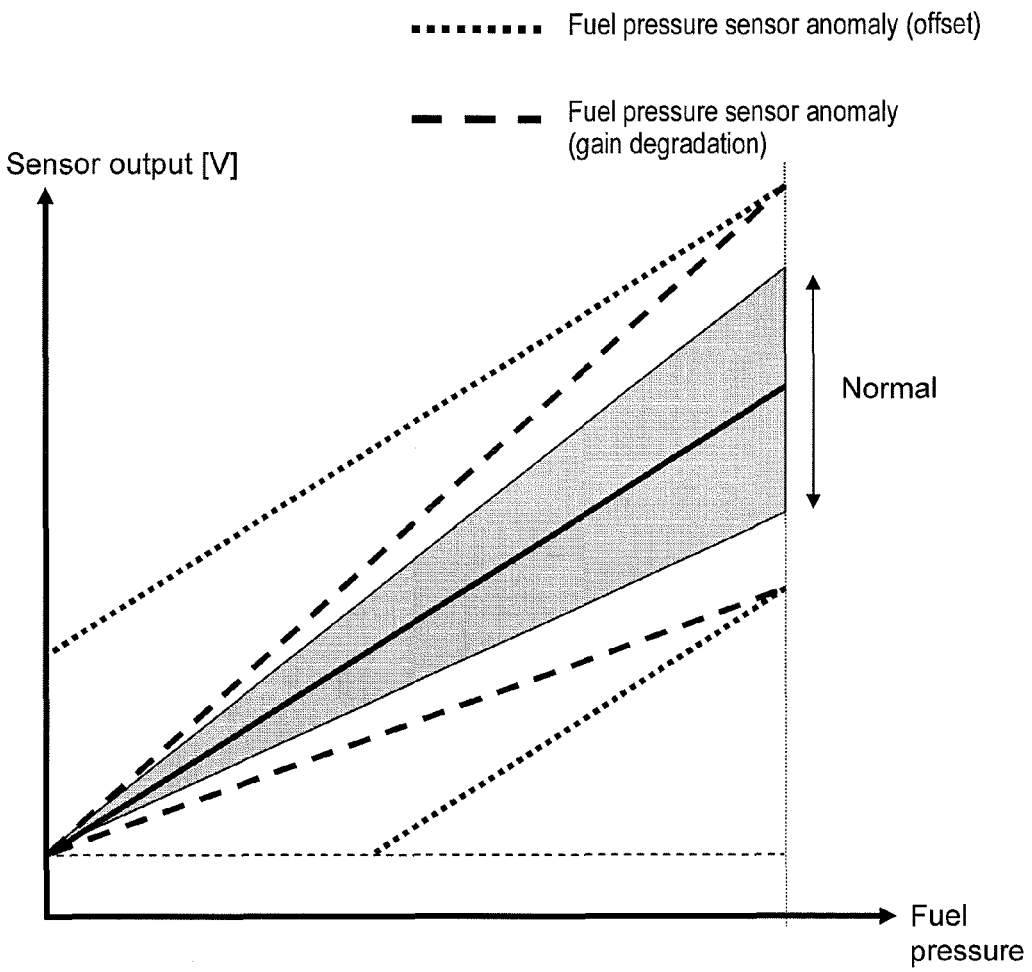
FIG. 6 is a diagram showing examples of anomalies in the fuel pressure sensor through the relationship between fuel pressure value and sensor output.

Fuel pressure sensor anomalies will now be described using FIG. 6. FIG. 6 is a diagram showing examples of anomalies in the fuel pressure sensor through the relationship between fuel pressure value and sensor output. Even when the fuel pressure sensor is operating properly, the sensor output varies linearly with respect to fuel pressure with some margin of error. This margin is ±1% or less for ordinary fuel pressure sensors on the market.

Representative examples of anomaly modes for fuel pressure sensors include offset anomalies where there is a parallel shift in the characteristics of the fuel pressure sensor, and gain anomalies where the output characteristics with respect to fuel pressure vary. As an example of an offset anomaly, one may think of a case where the ground or resistance value fluctuates due to a faulty connection in the wiring of the fuel pressure sensor, and so forth. On the other hand, examples of gain anomalies may include a case where the response with respect to pressure changes due to the aging of the diaphragm located at a pressure sensing part within the fuel pressure sensor, and so forth. With the present embodiment, such anomalies may be sensed as fuel pressure sensor anomalies.

Figure 7:
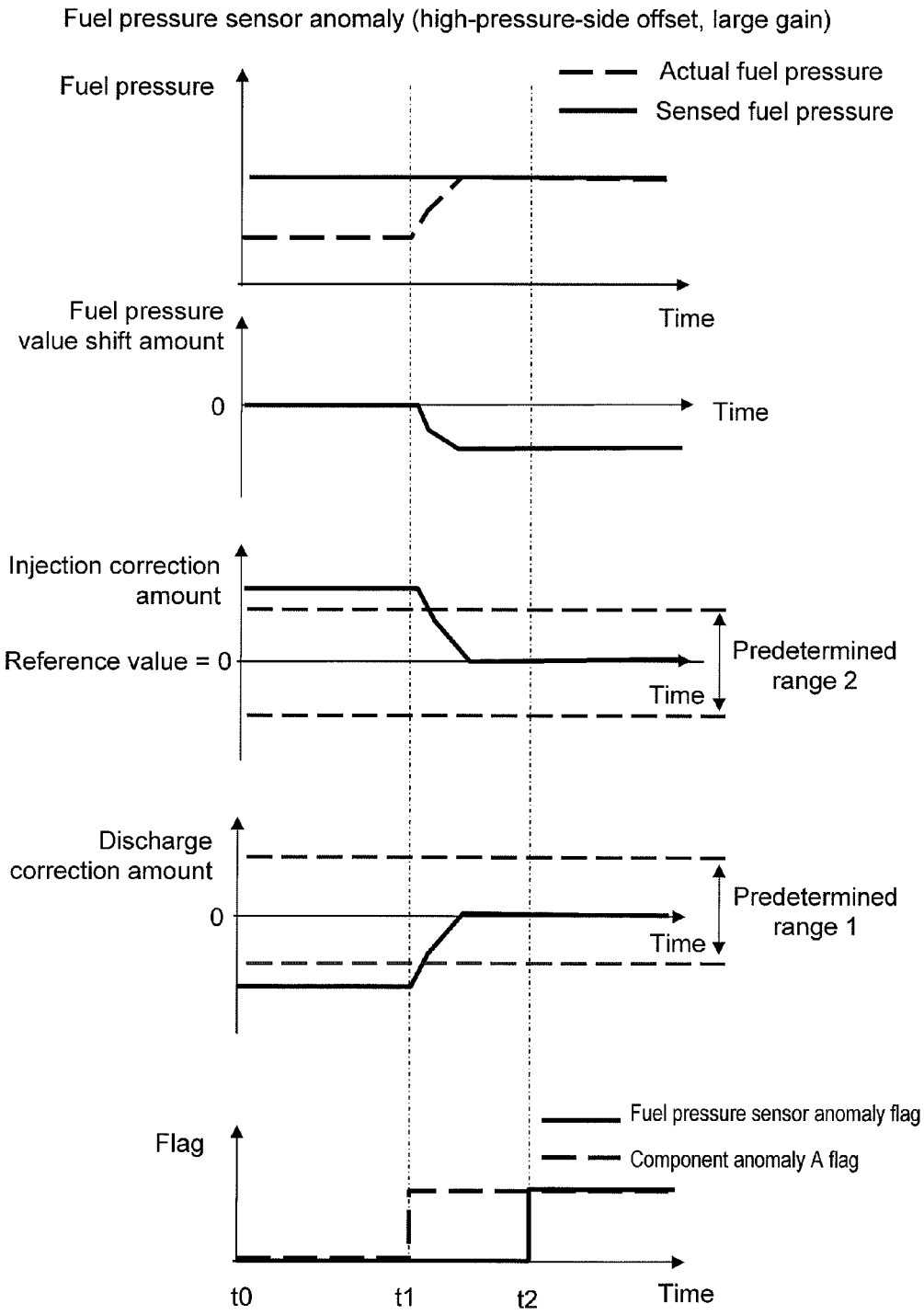
FIG. 7 shows time charts for a case in which there is a fuel pressure sensor failure (high-pressure-side offset, large gain).
Figure 8:
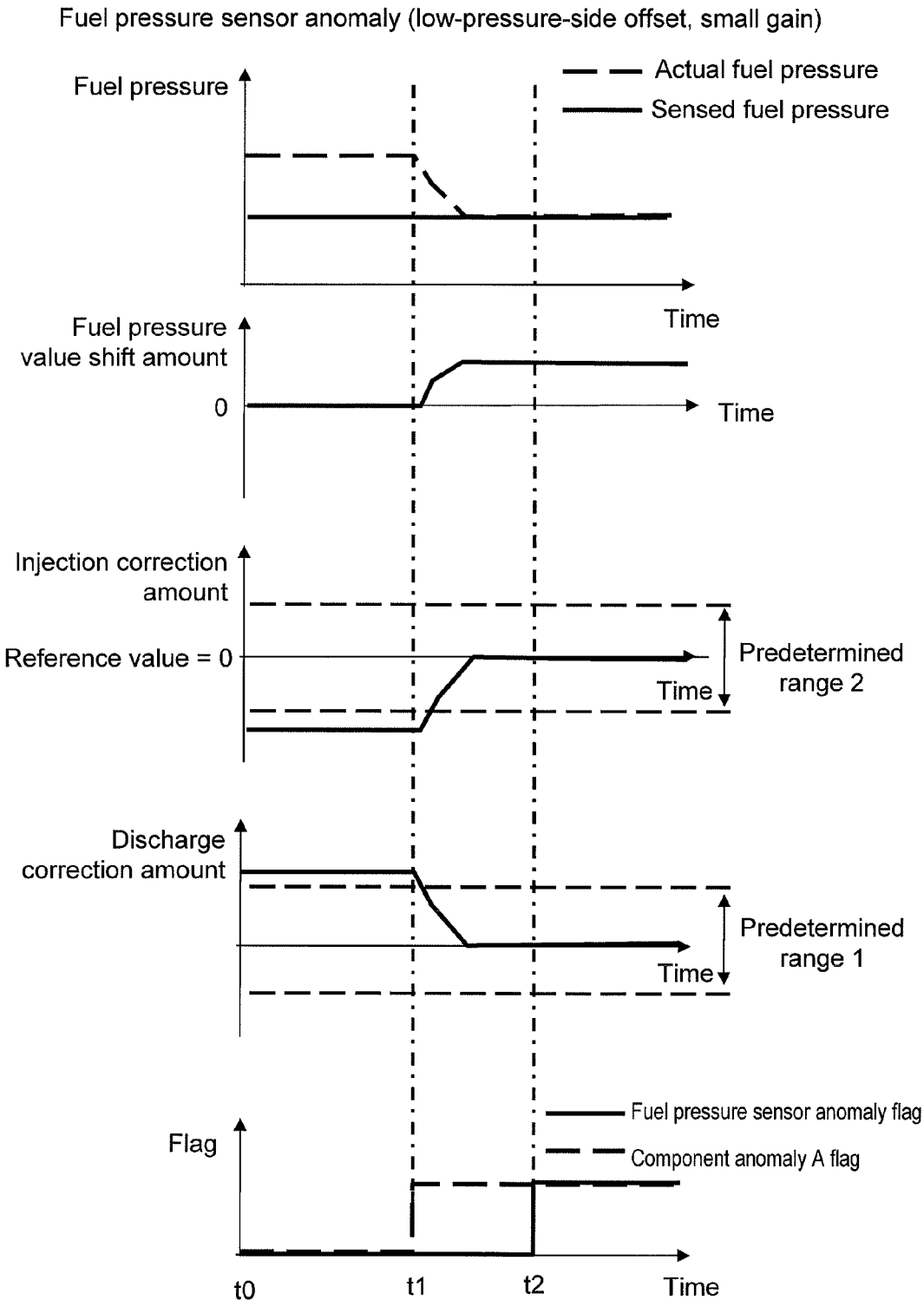
FIG. 8 shows time charts for a case in which there is a fuel pressure sensor failure (low-pressure-side offset, small gain).
Figure 9:
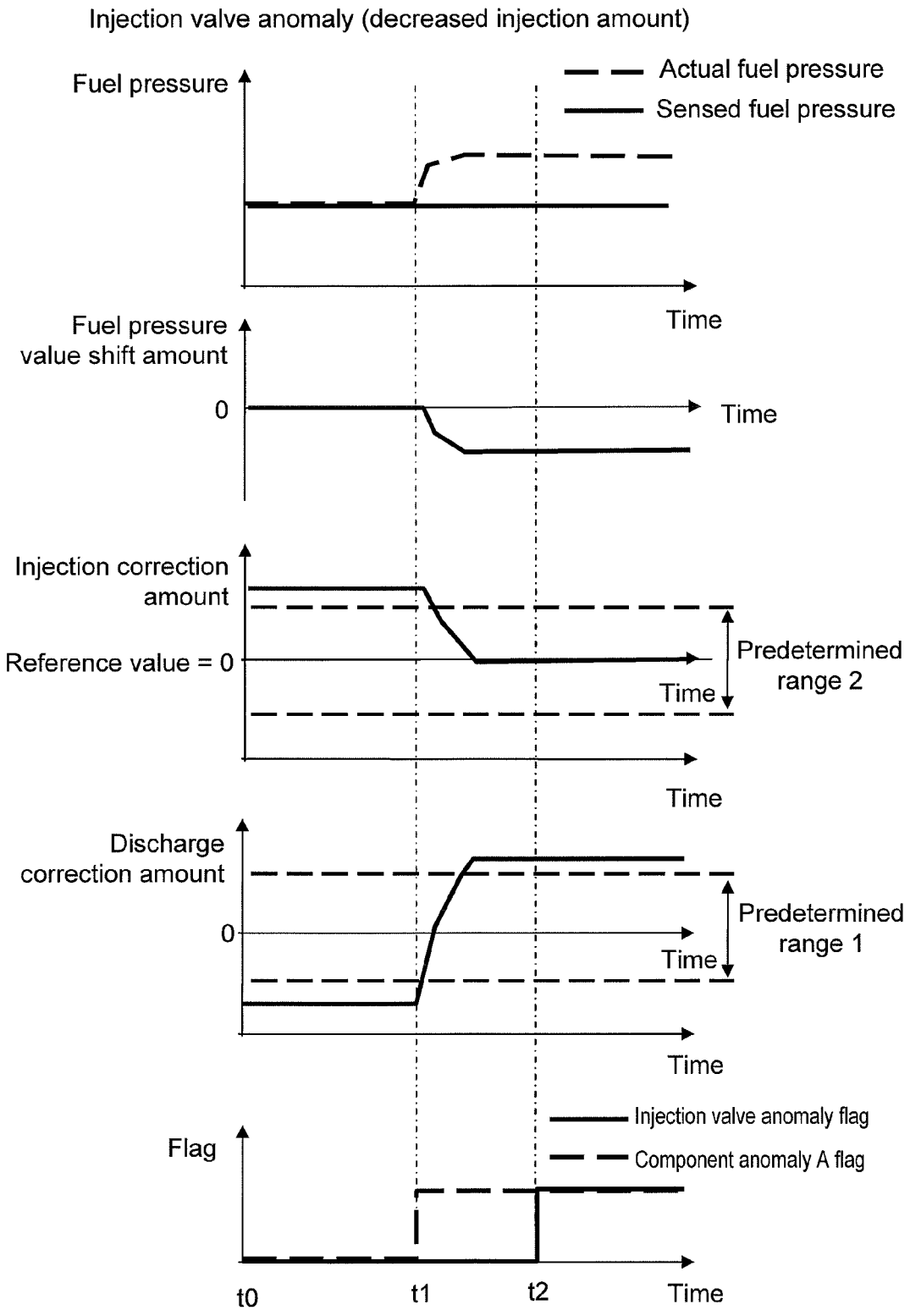
FIG. 9 shows time charts for a case in which there is an injection valve anomaly (decreased injection amount).

Examples of time charts for when the flowchart in FIG. 5 is executed are shown in FIGS. 7 to 9. FIG. 7 shows time charts for a case where there is a failure in the fuel pressure sensor (high-pressure-side offset, large gain). It shows, from the top, time charts for fuel pressure, fuel pressure value shift amount, injection correction amount, discharge correction amount, and flag.

With respect to fuel pressure, the dashed line represents the predicted actual fuel pressure (the actual fuel pressure), and the solid line represents the detected fuel pressure, which is a value containing the fuel pressure value shift amount. The fuel pressure value shift amount is the amount by which the detected fuel pressure is shifted and is calculated at the fuel pressure value shifting means. The injection correction amount is a value calculated by the air-fuel ratio feedback control means, and is a correction amount for the injection amount and is for bringing the detected air-fuel ratio to the target air-fuel ratio with the intake flow rate as a reference. The discharge correction amount is a value calculated by the fuel pressure feedback control means, and is a correction amount for the discharge amount and is for bringing the detected fuel pressure to the target fuel pressure.

For these time charts, the reference value is assumed to be 0. In the present embodiment, unless stated otherwise, the injection amount of the fuel injection valves (=basic fuel injection amount+injection correction amount) is given in a feedforward fashion as the discharge amount of the pump. Consequently, since it takes on a value close to 0 if there is no anomaly in the discharge correction amount either, the anomaly determination below becomes clear.

As shown in FIG. 7, a diagnosis is first started at time t0, and the component anomaly A flag is set to 1 at time t1. In other words, at this point (before a fuel pressure value shift is started), the injection correction amount deviates from predetermined range 2. After being thus set, a fuel pressure value shift is started so that the injection correction amount would converge towards the reference value (an injection correction amount of 0). Since, in the present case, the injection correction amount deviates from predetermined range 2 on the increase-side, the detected fuel pressure value is shifted in such a manner as to decrease the detected fuel pressure value (that is, the fuel pressure value shift amount is increased in the negative direction). Since the discharge correction amount after predetermined period 2 (t1 to t2) or longer has passed from when the fuel pressure value shift was started falls within predetermined range 1 (discharge correction amount becomes 0), the fuel pressure sensor anomaly flag is set to 1 as discussed above. It is noted that in the present case, the fuel pressure value shift is completed within predetermined period 2 (that is, the injection correction amount converges to the reference value), that t1 is the time at which the fuel pressure value shift is started, and that t2 is a time after the fuel pressure value shift has ended.

FIG. 8 shows time charts for a case where there is a failure in the fuel pressure sensor (low-pressure-side offset, small gain). The behavior is the opposite of that for the case of the fuel pressure sensor failure (high-pressure-side offset, large gain). In other words, since, in the present case, the injection correction amount is offset to the decrease-side, fuel pressure control is performed in such a manner as to increase the fuel pressure value.

When there is an anomaly in the fuel pressure sensor, because there is a difference between the detected fuel pressure and the actual fuel pressure as shown in FIGS. 7 and 8, the discharge correction amount and the injection correction amount deviate from their predetermined ranges. As such, in the present embodiment, the fuel pressure value shift value is computed so as to bring the injection correction amount to the reference value, and a fuel pressure value shift is performed based thereon, as a result of which the difference between the actual fuel pressure and the sensed fuel pressure decreases. As the offset in fuel pressure that was causing injection and discharge errors is thus resolved, the discharge correction amount also returns to its predetermined range. Thus, in the present embodiment, it may be determined that there is an anomaly in the fuel pressure sensor if, when a fuel pressure value shift is performed after the injection correction amount and the discharge correction amount have deviated from their predetermined ranges, the discharge correction amount returns to its predetermined range.

FIG. 9 shows time charts for a case where there is an anomaly in the injection valves (decreased injection amount). A diagnosis is started at t0, and the component anomaly A flag is set to 1 at t1. As a result, a fuel pressure value shift is started so as to bring the injection correction amount to a reference value. Since, in this case, the injection correction amount deviates to the increase-side, the fuel pressure value is so shifted as to decrease the fuel pressure value. However, since the discharge correction amount after predetermined period 2 (t1 to t2) or longer has passed from when the fuel pressure value shift was started falls outside of predetermined range 1, the injection valve anomaly flag is set to 1.

In addition, when there is an injection valve anomaly (increased injection amount), the behavior exhibited is the opposite of that of when there is an injection valve anomaly (decreased injection amount). Specifically, in the present case, since the injection correction amount deviates to the decrease-side, the fuel is pressurized so as to increase the fuel pressure value. However, in this case, too, as in FIG. 9, the discharge correction amount falls outside of predetermined range 1, and the injection valve anomaly flag is set to 1.

A reason for the above is that when there is an injection valve anomaly, the fuel pressure value is shifted so as to close the difference between the target air-fuel ratio of the present embodiment and the actual air-fuel ratio (to bring the injection correction amount to a reference value), which causes a fuel imbalance within the gallery. Consequently, the error between the actual fuel pressure and the sensed fuel pressure increases. In other words, with respect to the injection amount, since the increase or decrease caused by the fuel pressure value shift is comparable to the original injection error amount, the injection amount remains unchanged even after the fuel pressure value shift. However, the pump discharge amount increases because the fuel pressure value offset becomes greater. As a result, unlike the case of a fuel pressure sensor anomaly, the discharge correction amount does not return to predetermined range 1. Thus, in the present embodiment, if the discharge correction amount after a fuel pressure value shift does not return to a predetermined range, it may be determined that there is an anomaly in the injectors.

Thus, as is also evident from FIGS. 7 to 9, between a fuel pressure sensor anomaly and an injection valve anomaly, the amount of change in the discharge correction amount from when a fuel pressure value shift is started to when it is finished is clearly different. Specifically, in the case of a fuel pressure sensor anomaly, the amount of change in the change amount correction amount from when a fuel pressure value shift is started to when it is finished is small, whereas in the case of an injection valve anomaly, the amount of change in the change amount correction amount for the discharge correction amount from when a fuel pressure value shift is started to when it is finished is greater relative thereto. Given the above, the anomaly determination means may also determine which of the fuel injection valves and the fuel pressure sensor the anomaly is in based on the amount of change in the discharge correction amount during the shift, that is, on the amount of change in the discharge correction amount from before the fuel pressure value shift is started up to after it is finished, and it may also use it in conjunction with predetermined range (reference range) 1.

Figure 10:
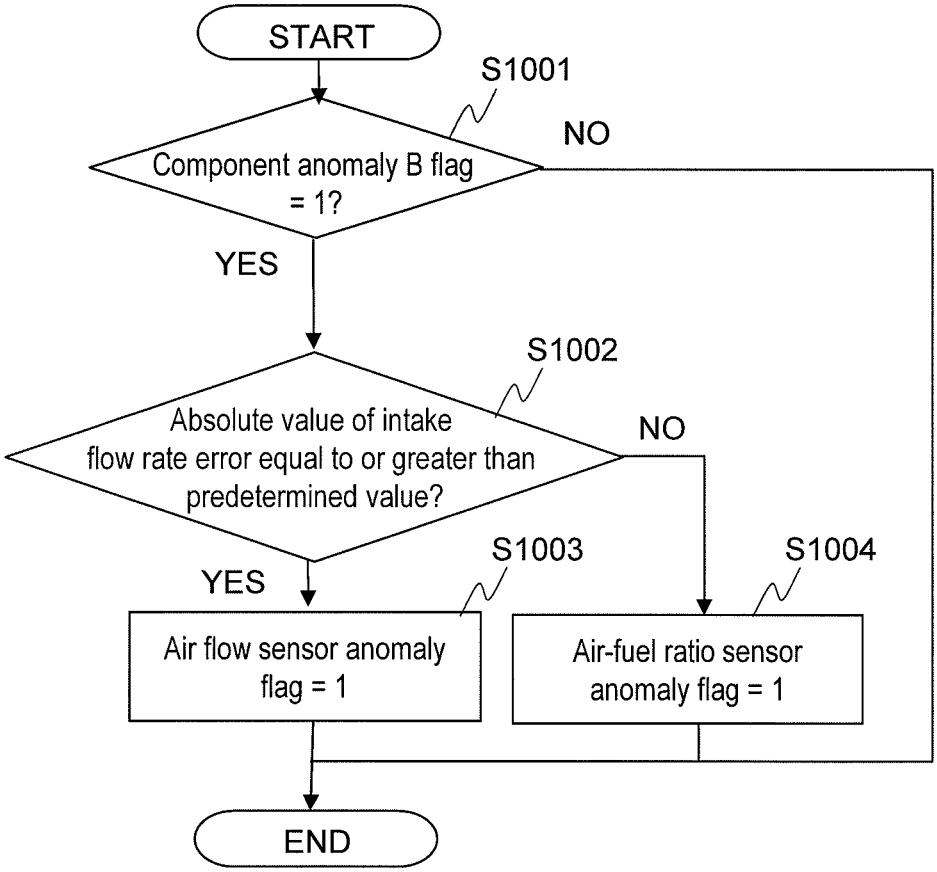
FIG. 10 is a flowchart for separating between anomalies in the air flow sensor and the air-fuel ratio sensor.

Next, a case where the component anomaly B (non-high-pressure fuel system anomaly) flag is set to 1 in step S407 shown in FIG. 4 is described. FIG. 10 is an example of a flowchart for separating between anomalies in the air flow sensor and the air-fuel ratio sensor. In the present embodiment, an anomaly site may be identified using an intake flow rate error computed by the intake flow rate error estimation means 301.

First, in step S1001, it is determined whether or not the component anomaly B flag is set to 1. Subsequent processes are not executed until step S1001 returns a YES.

Step S1001 returns a YES when the injection correction amount deviates from predetermined range 2. In this case, in step S1002, it is determined whether or not the absolute value of the intake flow rate error is equal to or greater than a predetermined value. This predetermined value is a value that takes sensing errors, estimation errors, etc., into account. If step S1002 returns a YES, the process proceeds to step S1003, and an air flow sensor anomaly flag is set to 1. If step S1002 returns a NO, the process proceeds to step S1004, and an air-fuel ratio sensor anomaly flag is set to 1. By thus comparing an estimated value for the intake flow rate with the output of the air flow sensor, it is possible to separate between an air flow sensor anomaly and an air-fuel ratio sensor anomaly.

By practicing the embodiment above, such effects as the following may be attained.

Using the discharge correction amount or injection correction amount from before the fuel pressure value shift, it may be identified whether it is (1) an anomaly in the high-pressure fuel system, or (2) some other anomaly (not in the high-pressure fuel system). Further, it is possible to separate (1) anomalies in the high-pressure fuel system into (1-1) anomalies in the high-pressure fuel pump and (1-2) other anomalies in the high-pressure fuel system.

Further, using the discharge correction amount from after the fuel pressure value shift by the fuel pressure value shifting means, it is possible to separate the (1-2) other anomalies in the high-pressure fuel system into (1-2a) anomalies in the fuel pressure sensor and (1-2b) anomalies in the fuel injection valves. Further, by slowing down the rate of change of the fuel pressure value shift (bringing it to more or less conventional rate of change), and decreasing the change in fuel pressure, it is possible to reduce exhaust degradation. Using the intake flow rate error, the (2) other (not in the high-pressure fuel system) anomalies may be separated into (2-1) anomalies in the air flow sensor and (2-2) anomalies in the air-fuel ratio sensor.

Second Embodiment

A diagnostic device for an internal combustion engine according to the second embodiment of the present invention is discussed using FIGS. 11 to 14.

Figure 11:
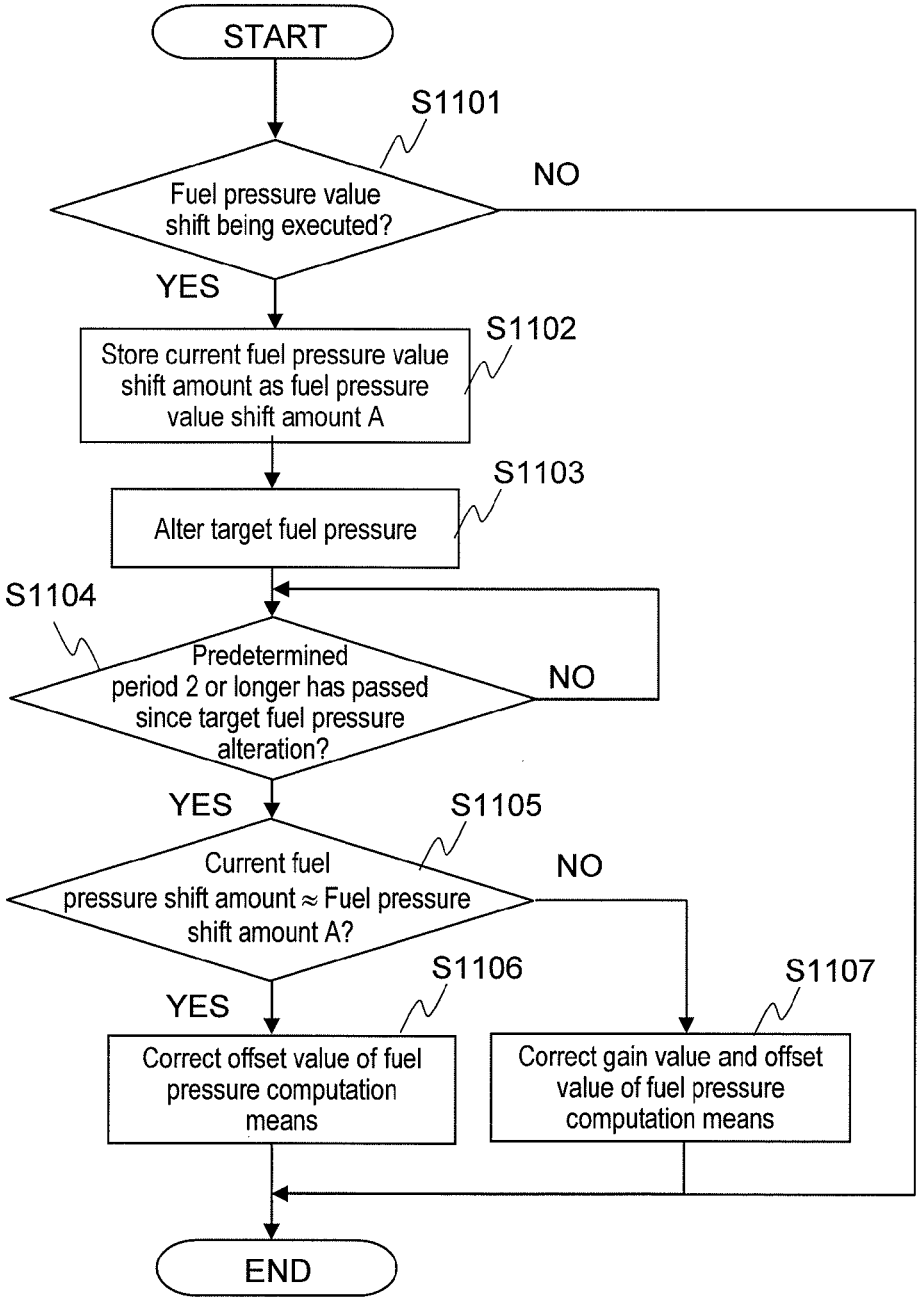
FIG. 11 is a flowchart for fuel pressure sensor correction according to the second embodiment.

FIG. 11 shows an example of a correction flowchart for the fuel pressure sensor. The following involves identifying an anomaly state (specifically, whether it is an offset anomaly, or a gain+offset anomaly) of the sensor output of the fuel pressure sensor after it has been determined in the first embodiment that there is an anomaly in the fuel pressure sensor, and further, performing a correction commensurate with this output anomaly of the fuel pressure sensor.

By implementing the present flowchart, it is possible to calculate the gain value and offset value in Equation (1), reduce the fuel pressure sensing error by the fuel pressure sensor, and prevent exhaust degradation.

First, in step S1101, it is determined whether or not a fuel pressure value shift is being performed by the fuel pressure value shifting means 304. If step S1101 returns a NO, the processes below are not performed.

If step S1101 returns a YES, the current fuel pressure value shift amount is stored as fuel pressure value shift amount A in step S1102. In so doing, in order to reduce variations in the fuel pressure value shift amount, a fuel pressure value shift amount on which a filtering process, e.g., first-order delay, etc., has been performed may be used as well.

Next, the target fuel pressure is altered in step S1103. This is because, between starting to shift the fuel pressure value and finishing shifting, in correcting the gain value and offset value in Equation (1) mentioned above used by the fuel pressure computation means, fuel pressure value shift amounts for at least two different fuel pressures become necessary.

In step S1104, it is determined whether or not predetermined period 2 or longer has passed since the target fuel pressure was altered. This is to compare fuel pressure value shift amounts in stable states at two different fuel pressures. The process of step S1104 is repeated until step S1104 returns a YES.

If step S1104 returns a YES, since this means that predetermined period 2 has passed, the process proceeds to step S1105, and it is determined whether or not the fuel pressure value shift amount and fuel pressure value shift amount A are comparable values. It is noted that since, in step S1105, it is being determined whether or not the fuel pressure shift value changes between before and after altering the target fuel pressure, the amount of change in the fuel pressure shift value per unit time may be used instead of the fuel pressure shift value.

If step S1105 returns a YES, the process proceeds to step S1106, and the offset value of the fuel pressure computation means in Equation (1) is corrected. The reason the amount of change in the fuel pressure value shift amount per unit time does not change even when the fuel pressure is altered is because it is always offset by a given amount. Since, in this case, it is determined to be a shift anomaly of the fuel pressure sensor, the offset value of the fuel pressure computation means in Equation (1) is corrected.

If step S1105 returns a NO, the process proceeds to step S1107, and the offset value and gain value of the fuel pressure computation means in Equation (1) are corrected. If the fuel pressure value shift amount also changes when the target fuel pressure is altered, this would mean that the offset amount varies depending on the fuel pressure, in which case it is determined that there is a fuel pressure sensor gain anomaly or a fuel pressure sensor gain+shift anomaly. Accordingly, the gain value and offset value in Equation (1), which is one mode of representation of a fuel pressure profile corresponding to the output voltage that is used by the fuel pressure computation means, are corrected.

Figure 12:
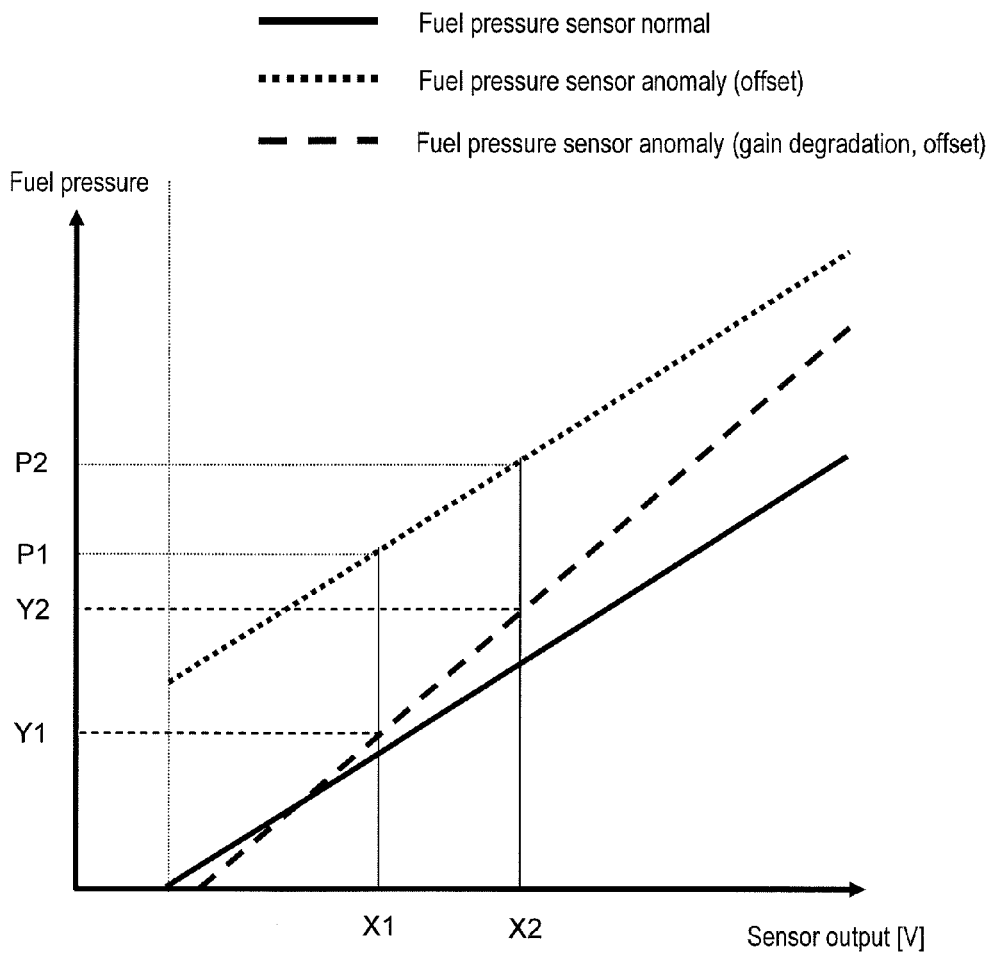
FIG. 12 is a diagram illustrating a fuel pressure sensor correction method according to the second embodiment.

FIG. 12 is a diagram illustrating a correction method for the fuel pressure sensor. As shown in FIG. 12, in general, regardless of whether it is a gain anomaly or an offset anomaly, the gain value and the offset value may be calculated with a linear equation using two x-axis values (sensor output) and y-axis (fuel pressure) values (X1, X2 and Y1, Y2 or P1, P2). In the event of a fuel pressure sensor offset anomaly, the intercept derived with a linear equation is taken to be a corrected shift value and the offset value in Equation (1) is switched therewith. In the event of a fuel pressure sensor gain offset anomaly, the gradient derived with a linear equation is taken to be a corrected gain value, and the intercept as a corrected offset value, and the gain value and offset value in Equation (1) are switched therewith.

Figure 13:
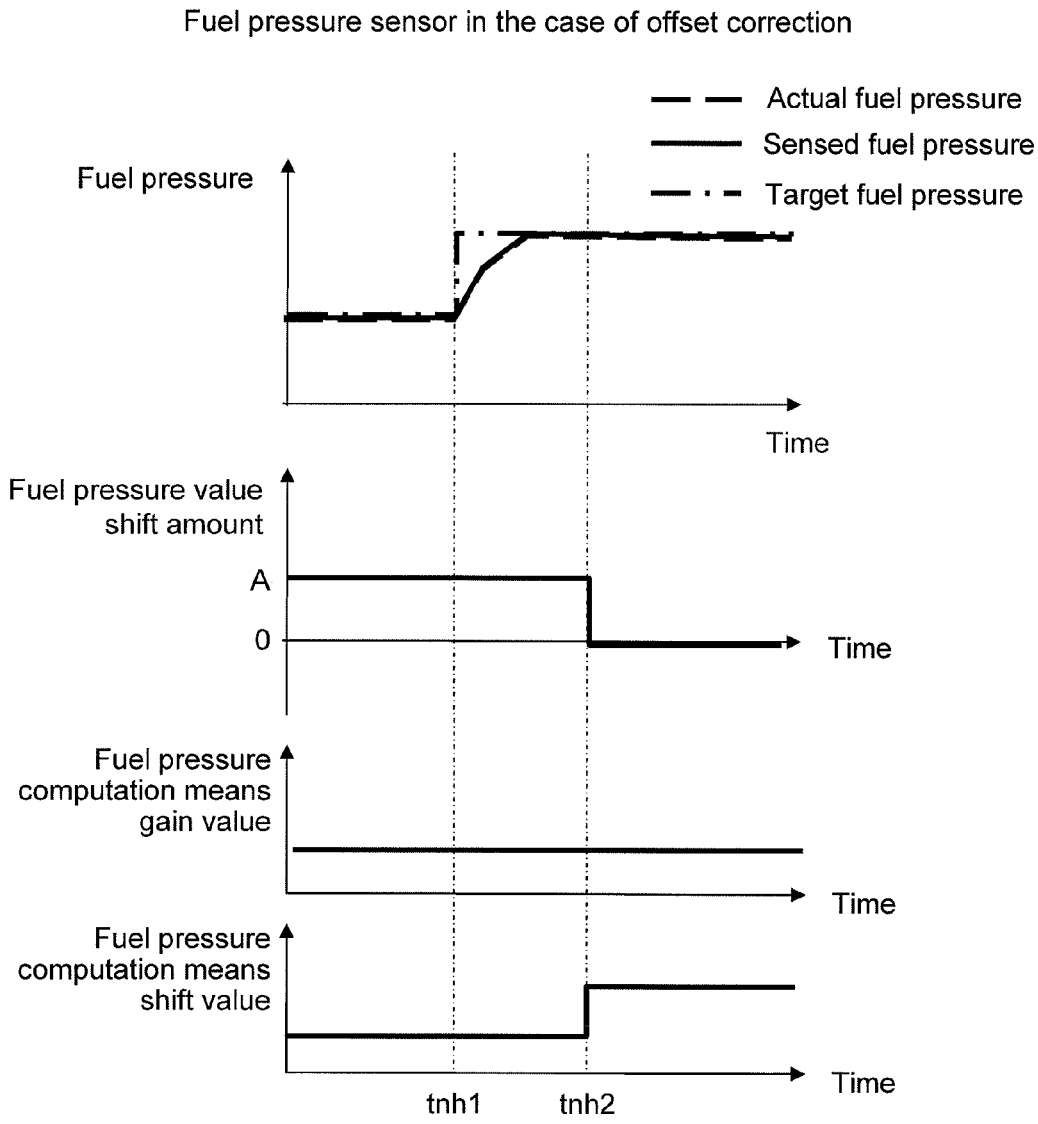
FIG. 13 shows time charts for a case where the offset value of a fuel pressure computation means is corrected according to the second embodiment.

FIG. 13 shows time charts for a case where the offset value of the fuel pressure computation means is corrected. They are, from the top, time charts for fuel pressure, fuel pressure value shift amount, gain value of fuel pressure means, and offset value by a correction of the fuel pressure computation means.

With respect to fuel pressure, the dashed line represents the predicted actual fuel pressure, the solid line the sensed fuel pressure, which is a value that includes the fuel pressure value shift amount, and the dashed one-dotted line the target fuel pressure. The fuel pressure value shift amount is a correction amount calculated at the fuel pressure value shifting means. The fuel pressure computation means gain value and offset value are the gain value and offset value used at the fuel pressure computation means.

In a state where a fuel pressure value shift is being performed, the fuel pressure value shift amount at time tnh1 is stored as fuel pressure value shift amount A, and the target fuel pressure is then altered. At time tnh2, at which predetermined period 2 or longer has passed, the current (after the target fuel pressure has been altered) fuel pressure value shift amount and fuel pressure value shift amount A (before the target fuel pressure is altered) are compared. It is noted that the respective fuel pressure sensor output voltages and detected fuel pressures corresponding to the fuel pressure value shift amounts to be compared, which are from before and after the target fuel pressure is altered, are stored. Since there is no change in the fuel pressure value shift amount, it is determined that fuel pressure value shift amount fuel pressure value shift amount A. Based on the output voltages and detected fuel pressures from before and after the alteration, the fuel pressure computation means's offset amount (the fuel pressure profile) is corrected by an amount corresponding to the fuel pressure value shift amount (fuel pressure correction means). As a result of the correction, the fuel pressure value shift amount decreases.

Figure 14:
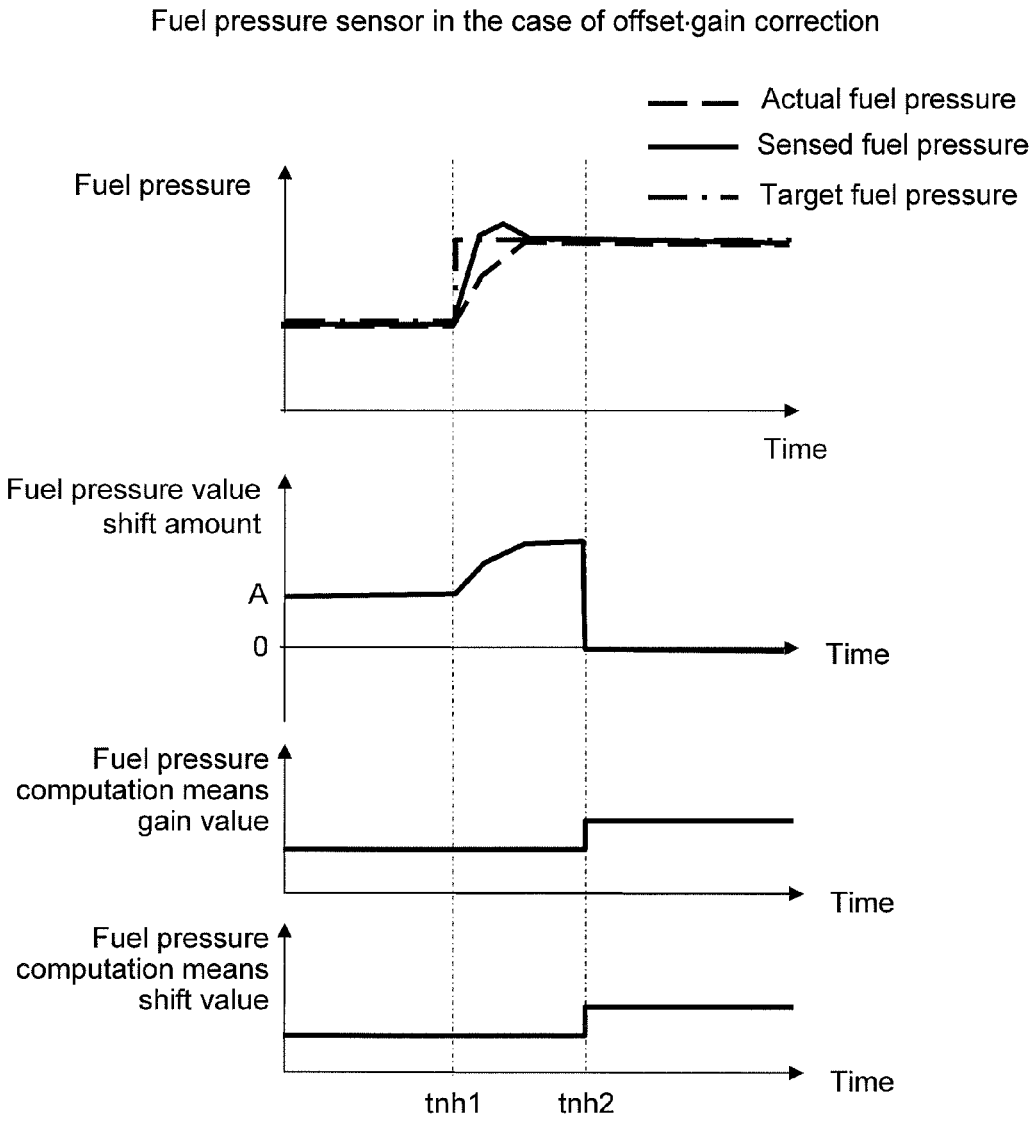
FIG. 14 shows time charts for a case where the offset value and gain value of a fuel pressure computation means are corrected according to the second embodiment.

FIG. 14 shows time charts for a case where the offset value and gain value of the fuel pressure computation means are corrected. In a state where a fuel pressure value shift is being performed, the fuel pressure value shift amount at time tnh1 is stored as fuel pressure value shift amount A, and the target fuel pressure is then altered. At time tnh2, at which predetermined period 2 or longer has passed, the current fuel pressure value shift amount and fuel pressure value shift amount A are compared. It is noted that the respective fuel pressure sensor output voltages and detected fuel pressures corresponding to the fuel pressure value shift amounts to be compared, which are from before and after the target fuel pressure is altered, are stored. Since there is a change in the fuel pressure value shift amount, it is determined that the fuel pressure value shift amount≠fuel pressure value shift amount A. Based on the relationship between the fuel pressure value shift amount and fuel pressure value shift amount A (specifically, based on the output voltages and detected fuel pressures corresponding to the above from before and after the alteration), the fuel pressure computation means's offset value and gain value (the fuel pressure profile) are corrected. As a result, the fuel pressure value shift amount decreases.

By implementing the embodiment above, it is possible to identify whether it is an offset anomaly or a gain+offset anomaly. Accordingly, fuel pressure sensor characteristics may be corrected with good precision with respect to fuel pressure sensor shift anomalies and gain+offset anomalies, and exhaust degradation in the event of a fuel pressure sensor anomaly may be reduced.

Third Embodiment

A diagnostic device for an internal combustion engine according to the third embodiment, which takes disturbances, such as evaporative purge, etc., into particular consideration, is described using FIG. 15 through FIG. 21.

Figure 15:
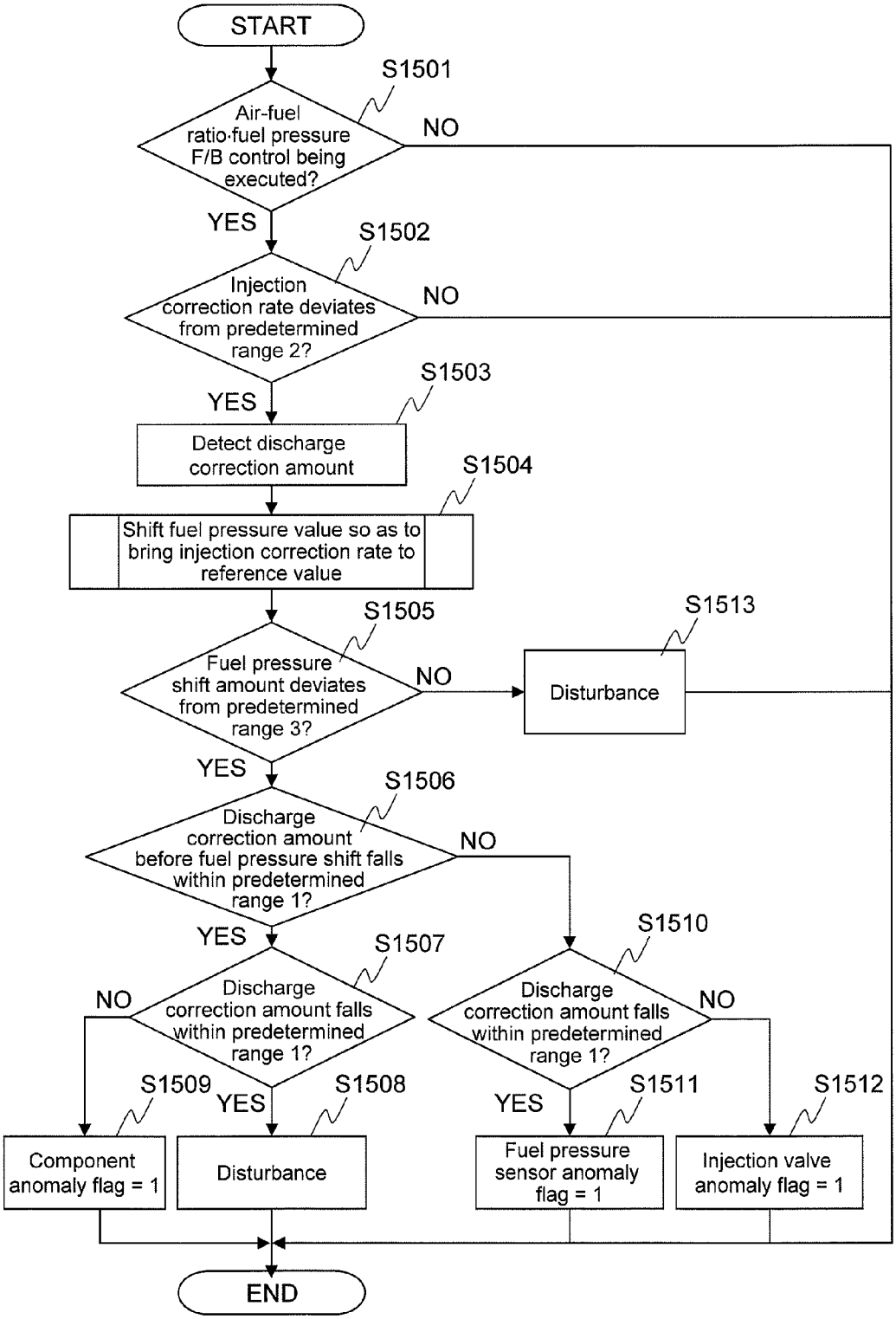
FIG. 15 is a flowchart for a diagnostic method performed by a diagnostic device according to the third embodiment.

FIG. 15 is an example of a flowchart for a diagnostic method performed by a diagnostic device of the third embodiment. In step S1501, it is checked whether or not an authorization condition for the present diagnostic method is fulfilled. In the present embodiment, in step S1501, it is determined whether or not air-fuel ratio feedback control and fuel pressure feedback control are being executed. Step S1501 is an authorization condition for a fuel pressure value shift in the present diagnostic method.

If step S1501 returns a YES, the process proceeds to step S1502, and it is determined whether or not the injection correction rate (injection correction amount) deviates from predetermined range 2.

If step S1502 returns a YES, the process proceeds to step S1503, and the discharge correction amount at that point is detected and stored. In step S1504, the fuel pressure value is shifted so as to bring the injection correction rate (injection correction amount) to a reference value.

While the fuel pressure value shift amount is being updated through a fuel pressure value shift in step S1504, it is determined in step S1505 whether or not this fuel pressure value shift amount deviates from predetermined range 3 (a range of fuel pressure errors for which the injection error caused by the fuel pressure error between the actual fuel pressure and the detected fuel pressure falls within predetermined range 2).

If step S1505 returns a NO, that is, if the fuel pressure value shift amount does not deviate from predetermined range 3, it is determined to be a disturbance, and the process is terminated. If step S1505 returns a YES, the process proceeds to step S1506, and it is determined whether or not the discharge correction amount prior to the fuel pressure value shift (the discharge correction amount stored in step S1503) falls within predetermined range 1.

If step S1506 returns a YES, the process proceeds to step S1507, and it is determined whether or not the current (after the fuel pressure value shift) discharge correction amount falls within predetermined range 1. If step S1507 returns a YES, the process proceeds to step S1508, where it is determined that the injection correction rate's deviation from predetermined range 2 in step S1502 was a product of disturbance, a determination of normalcy is made, and the process is terminated.

Further, if step S1507 returns a NO, the process proceeds to step S1509, and the component anomaly flag is set to 1, signifying that there is an anomaly in the air flow sensor, etc., and the process is terminated (details of this determination will be discussed in connection with FIG. 18). If step S1506 returns a NO, the process proceeds to step S1510, and it is determined whether or not the current (after the fuel pressure value shift) discharge correction amount falls within predetermined range 1. If step S1510 returns a YES, the process proceeds to step S1511, where the fuel pressure sensor anomaly flag is set to 1 and the process is terminated (details of this anomaly determination will be later discussed in connection with FIG. 16 discussed later). If step S1510 returns a NO, the process proceeds to step S1512, where the injection valve anomaly flag is set to 1 and the process is terminated (details of this anomaly determination will be discussed later in connection with FIG. 17).

With the present embodiment, as shown in this flowchart, when the injection correction rate deviates from predetermined range 2, the fuel pressure is constantly corrected so as to bring the injection correction rate (injection correction amount) to the reference value, and an anomaly in the high-pressure fuel system may be determined based on the fuel pressure value shift amount at that point or the discharge correction amounts before and after the fuel pressure value shift.

Figure 16:
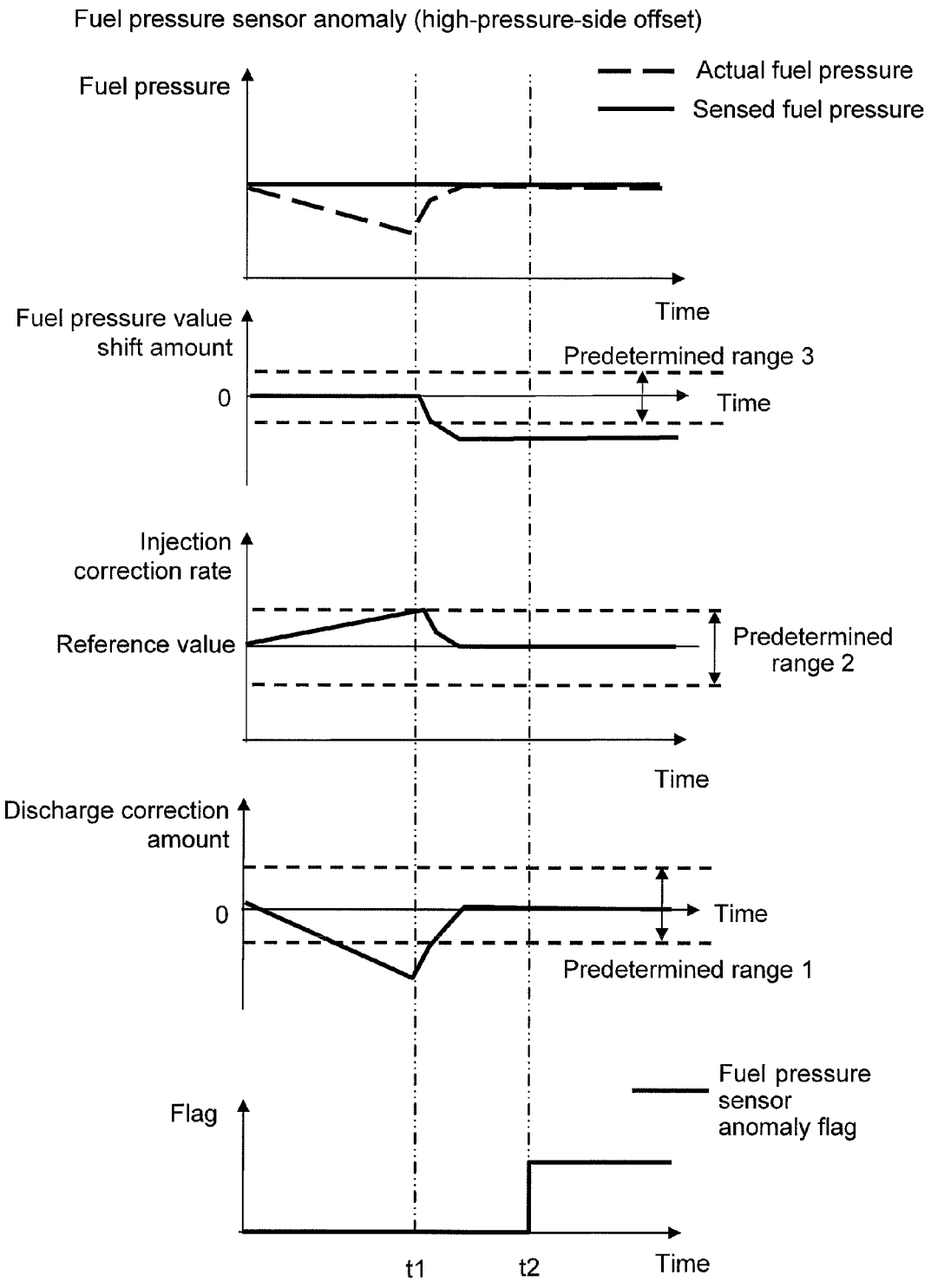
FIG. 16 shows time charts for a case in which there is a fuel pressure sensor anomaly (high-pressure-side offset) with respect to the third embodiment.

FIG. 16 shows examples of time charts for a case where there is a fuel pressure sensor anomaly (high-pressure-side offset). They are, from the top, time charts for fuel pressure, fuel pressure value shift amount, injection correction rate (injection correction amount), discharge correction amount, and flag. While the arrangement is the same as those of the time charts in FIG. 7 to FIG. 9, injection correction amount has been changed to injection correction rate. The injection correction rate used here is more strongly correlated with air-fuel ratio error, and it is easier to set diagnostic criteria than it is with injection correction amount.

A high-pressure-side offset anomaly in the fuel pressure sensor is an anomaly where the fuel pressure sensed at the fuel pressure sensor if offset to the high-pressure-side relative to the actual fuel pressure. In this case, since a fuel pressure with a value higher than the actual fuel pressure (see the solid line in the graph for fuel pressure in the diagram) is used for fuel injection control (air-fuel ratio FB control), the injection pulse, which is a drive signal for the fuel injection valves, is set to less than what is intended (the target injection pulse width that is actually required).

Consequently, the fuel injection amount (=basic fuel injection amount×injection correction rate) falls short, and the air-fuel ratio becomes lean. This air-fuel ratio's becoming lean is compensated for by increasing, through air-fuel ratio feedback control, the fuel injection amount by the amount by which it fell short so as to bring the detected air-fuel ratio up to the target air-fuel ratio (so as to make the detected air-fuel ratio richer), as a result of which the injection correction rate increases, which is accompanied by a drop in actual fuel pressure.

On the other hand, with high-pressure fuel pump control, since the sensed fuel pressure is greater than the actual fuel pressure, the discharge correction amount decreases (increases in the negative direction). This is because an increase in pump discharge amount due to a drop in actual fuel pressure is corrected by performing a discharge correction through fuel pressure control.

Here, in the present embodiment, a fuel pressure value shift is triggered by the deviation of the injection correction rate, which had been increasing gradually, from predetermined range 2 at time t1. With respect to the fuel pressure value shift, the detected fuel pressure value is shifted so as to bring the injection correction rate to a reference value (that is, to bring it back to predetermined range 2). The present anomaly is a case where the fuel pressure sensor is offset to the high-pressure side (it is not an anomaly in the actuator which is directly affected by an increase/decrease in fuel pressure). Accordingly, since, through this fuel pressure value shift, this sensed fuel pressure is corrected to an appropriate value (to become closer to the actual pressure) by an amount corresponding to the high-pressure-side shift, the injection correction rate gradually returns to predetermined range 2, which is the appropriate range. In other words, since the fuel injection amount was insufficient due to the difference between the actual fuel pressure and the sensed fuel pressure, as the injection correction rate approaches the reference value, the difference between the actual fuel pressure and the sensed fuel pressure decreases by virtue of the fuel pressure value shift.

Further, since what caused the discharge correction amount to increase in the negative direction is also the difference between the actual fuel pressure and the sensed fuel pressure, as this difference decreases, the discharge correction amount also decreases. At time t2, by which time a fuel pressure value shift state has been maintained for a given duration, the result of the anomaly determination is calculated. Specifically, since the fuel pressure value shift amount deviates from predetermined range 3, and since the discharge correction amount before the fuel pressure value shift deviates from predetermined range 1, and the discharge correction amount after fuel pressure correction falls within predetermined range 1, the fuel pressure sensor anomaly flag is set to 1. Since the same, or opposite, behaviors as those in FIG. 16 are exhibited for other fuel pressure sensor anomalies, they are omitted.

Figure 17:
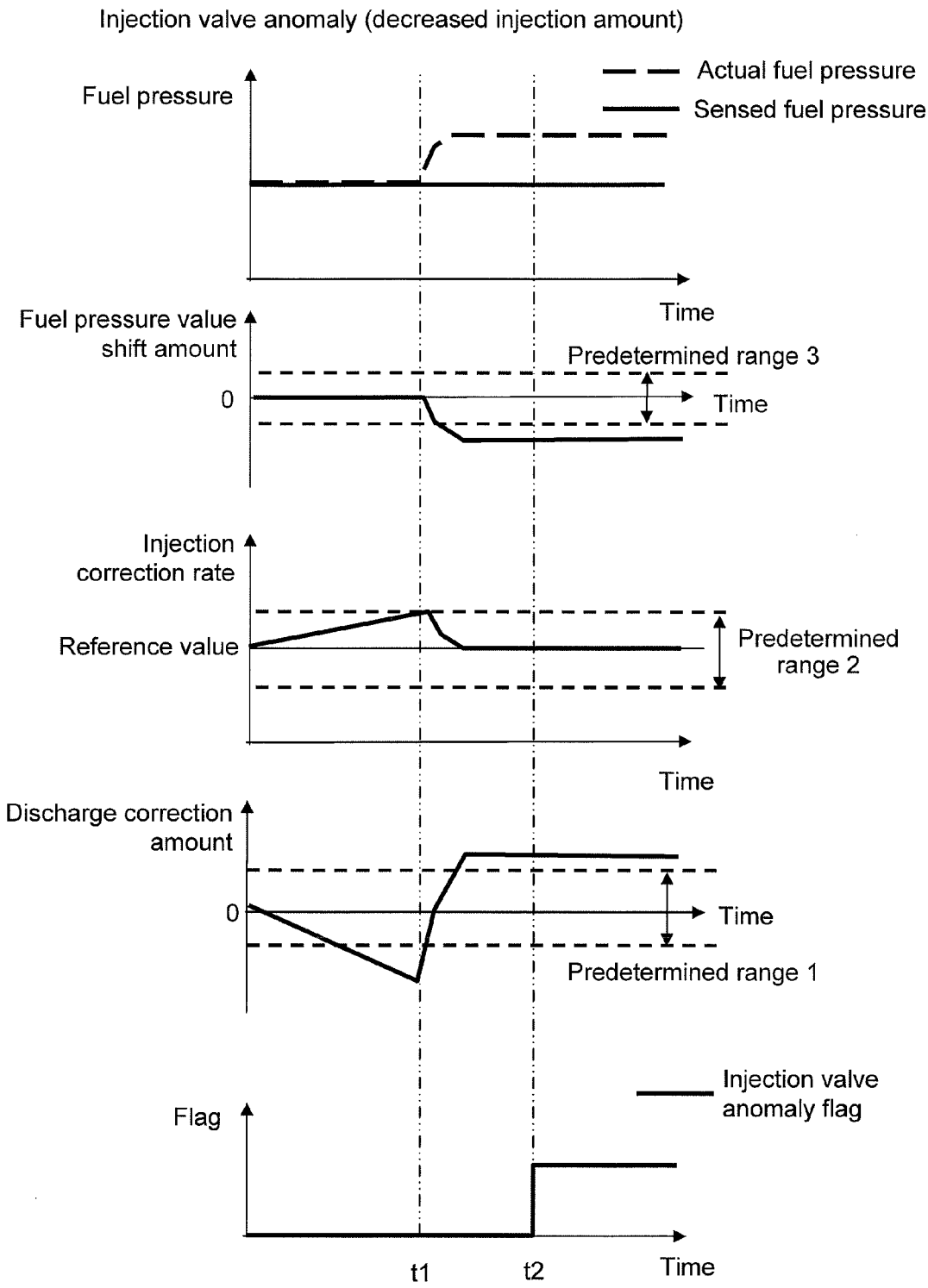
FIG. 17 shows examples of time charts for a case where there is an injection valve anomaly (a fuel injection amount decrease anomaly) with respect to the third embodiment.

FIG. 17 shows examples of time charts for a case where there is an injection valve anomaly (a fuel injection amount decrease anomaly). A fuel injection decrease anomaly is an anomaly where the fuel injection amount decreases as a result of the fuel injection valves being clogged, and so forth. As a result of this fuel injection amount decrease anomaly, the air-fuel ratio becomes leaner. As such, the injection amount is increased, through air-fuel ratio feedback control, by an amount corresponding to the deficit so that the detected air-fuel ratio attains the target air-fuel ratio (so that the detected air-fuel ratio becomes richer), and the injection correction rate increases. On the other hand, the discharge correction amount for the pump increases in the negative direction. This is a phenomenon that occurs when the injection correction rate is reflected in the injection amount of the fuel injection valves as a feed-forward amount for the discharge amount.

As the injection correction rate, which had been increasing gradually, deviates from predetermined range 2 (appropriate range) at time t1, a fuel pressure value shift is started. With respect to the fuel pressure value shift, the detected fuel pressure value is so shifted as to bring the injection correction rate to a reference value. The injection correction rate thus returns to predetermined range 2.

However, since, in the present case, what is actually malfunctioning is the fuel injection valve, by performing such a fuel pressure value shift, the output value of the fuel pressure detected by the fuel pressure sensor, which is without any anomaly, is corrected. The difference between the actual fuel pressure and the sensed fuel pressure consequently increases.

As a result, since, with respect to the high-pressure fuel pump control, control is performed with a sensed fuel pressure value that is lower than the actual fuel pressure, the discharge amount decreases. This occurs because, when the actual fuel pressure within the common rail is higher than the fuel pressure to be controlled, the discharge amount decreases even with the same pump control timing. As such, with respect to the pump control, control is performed in such a manner as to increase the discharge correction amount to attain a given fuel pressure.

Next, at time t2, by which time a fuel pressure value shift state has been maintained for a given duration, the result of the anomaly determination is calculated. Since the fuel pressure value shift amount deviates from predetermined range 3, and since the discharge correction amount before the fuel pressure value shift deviates from predetermined range 1, and the discharge correction amount after the fuel pressure value shift also deviates from predetermined range 1, the fuel injection valve anomaly flag is set to 1. Since the same, or opposite, behaviors as those in FIG. 17 are exhibited for other injection valve anomalies, they are omitted.

Figure 18:
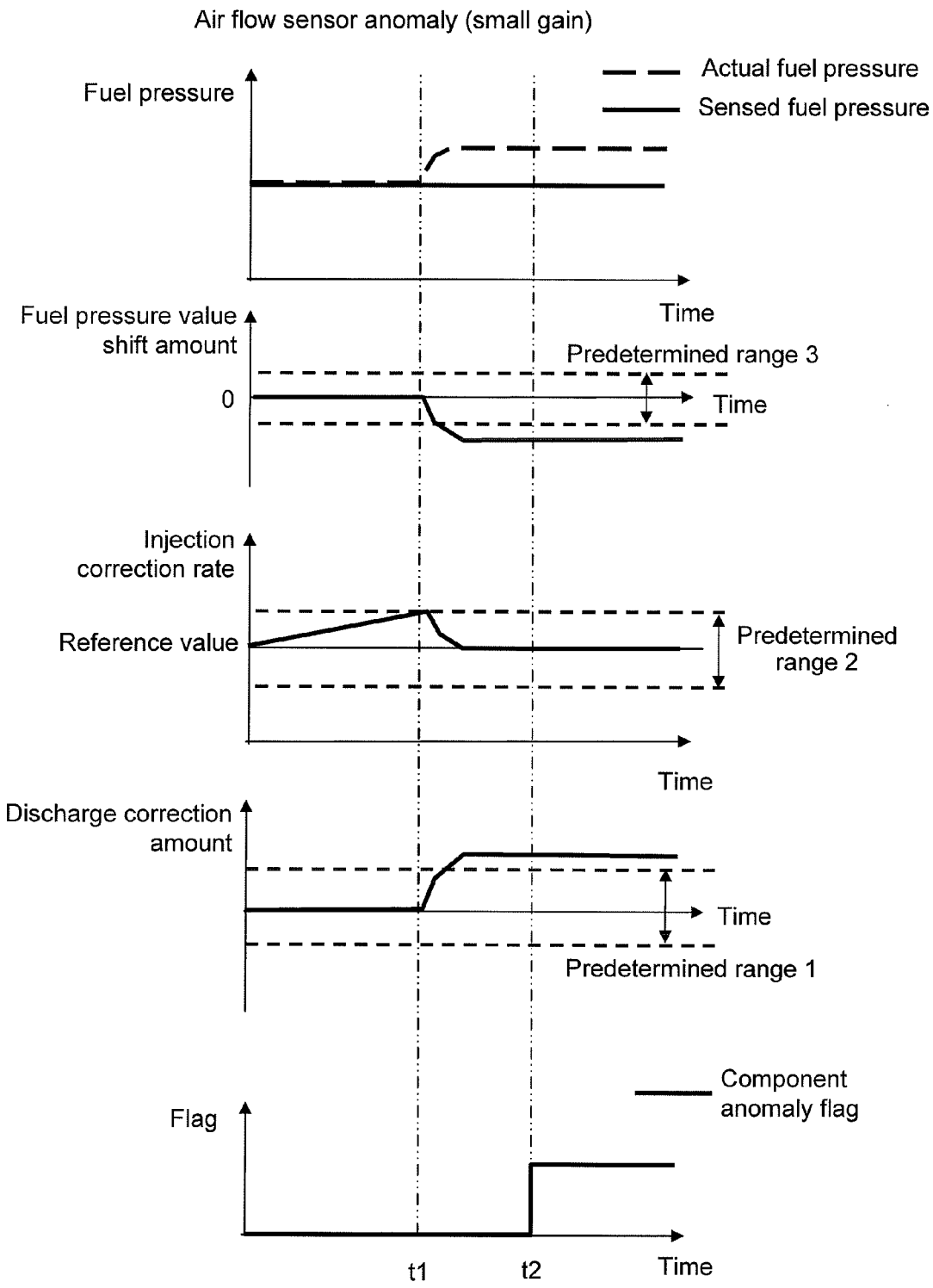
FIG. 18 shows time charts for a case in which there is an air flow sensor anomaly (small air flow gain) with respect to the third embodiment.

FIG. 18 shows time charts for a case where there is an air flow sensor anomaly (small air flow gain). A small air flow gain is a sensor sensitivity anomaly, where an intake flow rate that is less than the actual intake flow rate is sensed.

As a result, because the actual intake flow rate (the actual intake air amount) is greater than the sensed intake flow rate, the fuel injection amount becomes insufficient with respect to the actual air amount during air-fuel ratio control. Thus, the detected air-fuel ratio becomes leaner (shifts to the lean side). In so doing, because the injection amount is increased and corrected by an amount corresponding to the deficit through air-fuel ratio feedback control, the injection correction rate increases. On the other hand, with respect to the pump control, since the anomaly amount of the intake flow rate of the air flow sensor is cancelled out by the increase in injection correction rate, the discharge correction amount does not increase.

As the injection correction rate, which had been increasing gradually, deviates from predetermined range 2 at time t1, a fuel pressure value shift is started. With respect to the fuel pressure value shift, the detected fuel pressure value is so shifted as to bring the injection correction rate to a reference value. The injection correction rate consequently returns to predetermined range 2.

However, in this case, too, as with the injector anomaly described earlier, as a result of performing the fuel pressure value shift, the difference between the actual fuel pressure and the sensed fuel pressure increases, and the discharge correction amount consequently increases. At time t2, by which time a fuel pressure value shift state has been maintained for a given duration, the result of the anomaly determination is calculated. Since the fuel pressure value shift amount deviates from predetermined range 3, and since the discharge correction amount before the fuel pressure value shift falls within predetermined range 1, and the discharge correction amount after the fuel pressure value shift deviates from predetermined range 1, the component anomaly flag is set to 1. Since the same, or opposite, behaviors as those in FIG. 18 are exhibited for other air flow sensor anomalies, they are omitted.

Figure 19:
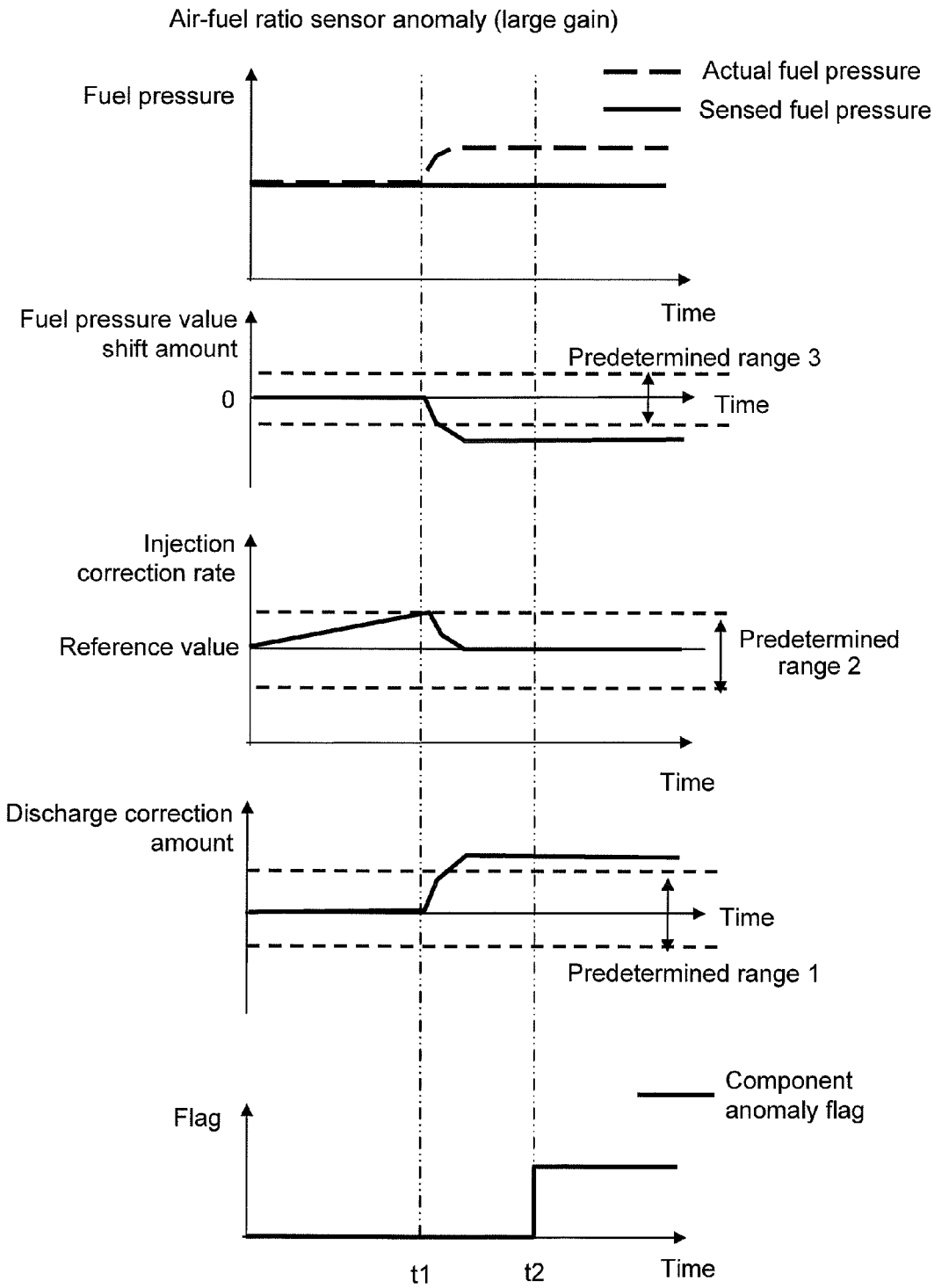
FIG. 19 shows time charts for a case in which there is an air-fuel ratio sensor anomaly (large air-fuel ratio gain) with respect to the third embodiment.

FIG. 19 shows time charts for a case where there is an air-fuel ratio sensor anomaly (large air-fuel ratio gain). A large air-fuel ratio gain anomaly is a sensitivity anomaly in the air-fuel ratio sensor. With this anomaly, air-fuel ratio feedback control is performed in a state where an air-fuel ratio that is leaner than the actual air-fuel ratio is sensed.

As a result, the injection correction rate increases in order to correct the lean air-fuel ratio towards the rich side. In this case, the injection amount increases by the injection correction rate. However, since this increased injection amount is reflected in pump control with a feed-forward amount, the discharge correction amount remains more or less unchanged.

Then, as the injection correction rate, which had been increasing gradually, deviates from predetermined range 2 at time t1, a fuel pressure value shift is started. With respect to the fuel pressure value shift, the fuel pressure value is so shifted as to bring the injection correction rate to a reference value. The injection correction rate consequently returns to predetermined range 2.

However, since the difference between the actual fuel pressure and the sensed fuel pressure increases, the discharge correction amount increases as in the case of the air flow sensor. Then, at t2, by which time a fuel pressure value shift state has been maintained for a given duration, the result of the anomaly determination is calculated. Since the fuel pressure value shift amount deviates from predetermined range 3, and since the discharge correction amount before the fuel pressure value shift falls within predetermined range 1, and the discharge correction amount after the fuel pressure value shift deviates from predetermined range 1, the component anomaly flag is set to 1. Since the same, or opposite, behaviors as those in FIG. 19 are exhibited for other air-fuel ratio sensor anomalies, they are omitted.

Figure 20:
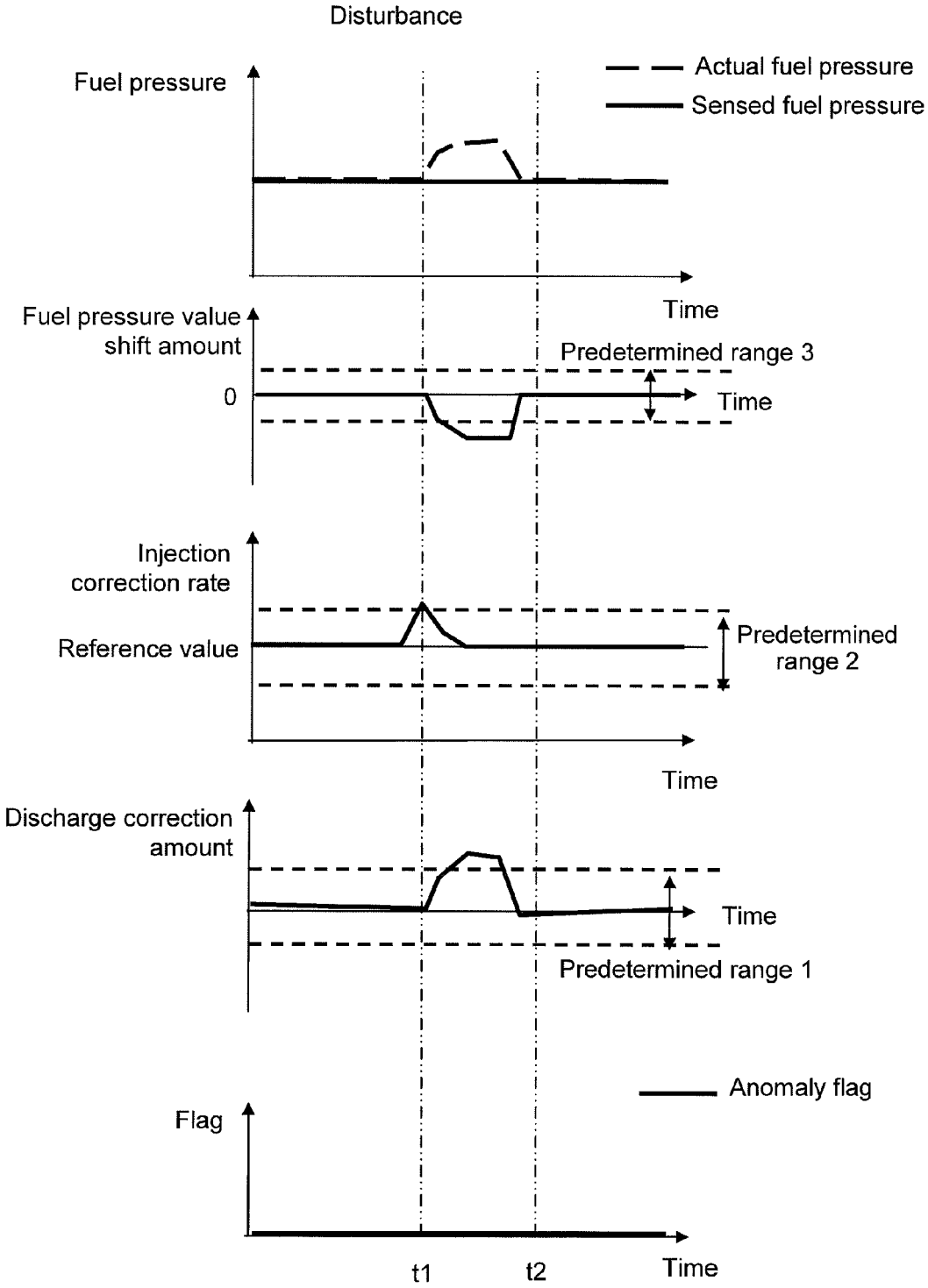
FIG. 20 shows time charts for a case in which there is a disturbance with respect to the third embodiment.

FIG. 20 shows time charts for a case where a disturbance occurs. Even if the injection correction rate were to increase due to an occurrence of a disturbance, e.g., unanticipated evaporative contamination, etc., a fuel pressure value shift is started once the injection correction rate deviates from predetermined range 2 at time t1. With respect to the fuel pressure value shift, since the fuel pressure value is so shifted as to bring the injection correction rate to a reference value, the injection correction rate returns to predetermined range 2. However, as the influence of the disturbance that occurred gradually decreases, the fuel pressure value shift amount also decreases, and the fuel pressure value shift amount falls within predetermined range 3, which is the appropriate range, and it is determined to be a disturbance.

Thus, as is also evident from FIG. 20, by performing an anomaly determination diagnosis while further taking into account the shift amount for the detected fuel pressure value from when a shift in the fuel pressure value is started up to when the shift is finished, it is possible to also make determinations of disturbances, as well as to avoid misdiagnosing anomalies.

FIG. 21 is a table summarizing anomaly determination results with respect to the flowchart shown in FIG. 15. In the case of a fuel pressure sensor anomaly, since the anomaly state is appropriately corrected by performing a fuel pressure value shift, both the injection correction rate and the discharge correction amount fall within their predetermined normal ranges (reference ranges) after the fuel pressure value shift. As such, it is determined to be a fuel pressure sensor anomaly if the fuel pressure value shift amount deviates from a predetermined range dictated by exhaust criteria.

In the case of an injector anomaly, both the discharge correction amounts before and after the fuel pressure value shift deviate from the normal range (reference range). Before the fuel pressure value shift, the discharge correction amount deviates from the normal range due to an injector injection error or a pump discharge error. After the fuel pressure value shift, the discharge correction amount further deviates from the normal range because the pump discharge error increases.

Although the pre-correction injection correction rate deviates from the range in the case of air flow sensor and air-fuel ratio sensor anomalies, they may be distinguished from the injector anomaly mentioned above based on the fact that their pre-correction discharge correction amounts fall within the range. Further, in the case of a disturbance, since the fuel pressure value shift amount does not remain outside of the predetermined range, misdiagnoses may be prevented. Accordingly, with the present embodiment, based on the above-mentioned relationship among fuel pressure value shift amount, injection correction rate and discharge correction amount, diagnoses that are robust against disturbances may be realized.

Although embodiments of the present invention have been described in detail above using the drawings, the actual configuration is by no means limited to these embodiments, and design modifications made within a scope that does not depart from the spirit of the present invention are to be included in the present invention.

LIST OF REFERENCE NUMERALS

101: Intake pipe
102: Air cleaner
102*a*: Inlet part
103: Air flow sensor
104: Throttle sensor
105: Throttle body
105*a*: Electronically-controlled throttle valve
106: Collector
107: Internal combustion engine
107*a*: Piston
107*b*: Cylinder
107*c*: Combustion chamber
108: Fuel tank
109: Low-pressure fuel pump
110: Fuel pressure regulator
111: High-pressure fuel pump
112: Fuel injection valve
113: Ignition coil
114: Ignition plug
115: Control unit
116: Cam angle sensor
117: Crank angle sensor
118: Air-fuel ratio sensor
119: Exhaust pipe
120: Catalyst
121: Fuel pressure sensor
124: Motor
202: Injection valve control means
203: High-pressure fuel pump control means
205: Fuel rail
207: Cam
300: Control/diagnostic device (diagnostic device for internal combustion engine)
301: Intake flow rate error estimation means
302: Air-fuel ratio feedback control means (injection correction amount computation means)
303: Fuel pressure computation means
304: Fuel pressure value shifting means
305: Fuel pressure feedback control means (discharge correction amount computation means)
306: Anomaly determination means

The invention claimed is:

1. A diagnostic device for a direct injection internal combustion engine that comprises a fuel injection valve that injects fuel into a combustion chamber of the internal combustion engine, a fuel rail that stores fuel that is to be injected through the fuel injection valve, a fuel pump that discharges fuel to the fuel rail, a fuel pressure sensor that detects a fuel pressure within the fuel rail, and an air-fuel ratio sensor that detects an air-fuel ratio within exhaust gas discharged from the internal combustion engine, the diagnostic device comprising:

injection amount computation means that computes an injection amount of the fuel injection valve based on an operation state of the internal combustion engine;

injection correction amount computation means that computes an injection correction amount for the injection amount so as to bring the detected air-fuel ratio to a target air-fuel ratio;

fuel injection valve control means that corrects the injection amount based on the injection correction amount, and controls the fuel injection valve so as to inject fuel in the corrected injection amount;

discharge amount computation means that computes a discharge amount of the fuel pump based on the corrected injection amount;

discharge correction amount computation means that computes a discharge correction amount for the discharge amount so as to bring the detected fuel pressure to a target fuel pressure;

fuel pump control means that corrects the discharge amount based on the discharge correction amount, and controls the fuel pump so as to discharge fuel in the corrected discharge amount;

fuel pressure value shifting means that performs, when the injection correction amount deviates from a predetermined range, a shift in a fuel pressure value of the detected fuel pressure until the injection correction amount converges to a predetermined amount within the predetermined range, and that performs, when the injection correction amount deviates from the predetermined range to an increase-side, a shift in the detected fuel pressure value to decrease the fuel pressure value, thereby converging the injection correction amount to the predetermined amount within the predetermined range, and performs, when the injection correction amount deviates from the predetermined range to a decrease-side, a shift in the detected fuel pressure value to increase the fuel pressure value, thereby converging the injection correction amount to the predetermined amount within the predetermined range; and anomaly determination means that determines which of the fuel pump, the fuel injection valve, and the fuel pressure sensor has an anomaly based on the discharge correction amount before the fuel pressure value shift starts and after the fuel pressure value shift ends and on the injection correction amount before the fuel pressure value shift starts.

2. The diagnostic device for an internal combustion engine according to claim 1, wherein the anomaly determination means determines which of the fuel injection valve and the fuel pressure sensor has an anomaly based on an amount of change in the discharge correction amount from before the shift starts up to after the shift ends.

3. The diagnostic device for an internal combustion engine according to claim 1, wherein the anomaly determination means:

sets a reference range for the discharge correction amount that serves as a reference for anomaly determination;

determines there is an anomaly in the fuel pressure sensor if the discharge correction amount before the shift starts deviates from the reference range and the discharge correction amount after the shift ends falls within the reference range; and determines there is an anomaly in the fuel injection valve if the discharge correction amounts before the shift starts and after the shift ends deviate from the reference range.

4. The diagnostic device for an internal combustion engine according to claim 3, wherein the anomaly determination means determines there is an anomaly in the air-fuel ratio sensor, or an anomaly in an air flow sensor that measures intake air amount, if the discharge correction amount before the shift starts falls within the reference range and the discharge correction amount after the shift ends deviates from the reference range.

5. The diagnostic device for an internal combustion engine according to claim 1, wherein the fuel pressure value shifting means performs the shift in the fuel pressure value until the injection correction amount converges to 0.

6. The diagnostic device for an internal combustion engine according to claim 1, wherein the anomaly determination means performs a diagnosis of the anomaly determination further taking into account a shift amount in the fuel pressure value from when the shift in the fuel pressure value starts up to when the shift ends.

7. The diagnostic device for an internal combustion engine according to claim 1, wherein the anomaly determination means:

alters the target fuel pressure during a period of from when the shift starts up to when the shift ends if it is determined that there is an anomaly in the fuel pressure sensor; and determines an anomaly state of an output of the fuel pressure sensor by comparing amounts of change in a shift amount in the fuel pressure value before and after the target fuel pressure is altered.

8. The diagnostic device for an internal combustion engine according to claim 7, wherein, if the amounts of change before and after the target fuel pressure is altered are the same, the anomaly determination means determines the anomaly state of the output of the fuel pressure sensor to be an anomaly state where an output value of the fuel pressure sensor is offset.

9. The diagnostic device for an internal combustion engine according to claim 7, further comprising fuel pressure computation means that, using a fuel pressure profile with respect to output voltage from the fuel pressure sensor, computes the detected fuel pressure from the output voltage, wherein if it is determined that there is an anomaly in the fuel pressure sensor, the anomaly determination means corrects the fuel pressure profile based on the output voltages and the detected fuel pressures before and after the alteration of the target fuel pressure by the anomaly determination means.

10. The diagnostic device for an internal combustion engine according to claim 1, wherein the fuel pressure value shifting means stores a change amount in detected fuel pressure value that varies in accordance with the correction of the fuel injection amount before the shift starts, and performs the shift in the fuel pressure value based on the change amount.

* * * * *